US012209848B1

(12) United States Patent
Wilson

(10) Patent No.: US 12,209,848 B1
(45) Date of Patent: Jan. 28, 2025

(54) DESPUN WING CONTROL SYSTEM FOR GUIDED PROJECTILE MANEUVERS

(71) Applicant: Northrop Grumman Systems Corporation, Falls Church, VA (US)

(72) Inventor: Michael J. Wilson, Lakeville, MN (US)

(73) Assignee: Northrop Grumman Systems Corporation, Falls Church, VA (US)

( * ) Notice: Subject to any disclaimer, the term of this patent is extended or adjusted under 35 U.S.C. 154(b) by 0 days.

(21) Appl. No.: 18/536,527

(22) Filed: Dec. 12, 2023

Related U.S. Application Data

(63) Continuation of application No. 18/107,554, filed on Feb. 9, 2023, now Pat. No. 12,031,802, which is a (Continued)

(51) Int. Cl.
*F42B 10/64* (2006.01)
*F42B 10/26* (2006.01)
(Continued)

(52) U.S. Cl.
CPC ..... *F42B 10/64* (2013.01); *F42B 10/26* (2013.01); *F42B 10/54* (2013.01); *F42B 30/10* (2013.01)

(58) Field of Classification Search
CPC ..... F42B 10/44; F42B 10/06; F42B 10/60; F42B 10/64; F42B 10/26; F42B 10/04; F42B 10/22; F42B 14/06
See application file for complete search history.

(56) References Cited

U.S. PATENT DOCUMENTS 2,340,781 A 2/1944 Wagner
2,513,157 A 6/1950 Ferris et al.
(Continued)

FOREIGN PATENT DOCUMENTS

CA 2441277 10/2002
EP 0675335 10/1995
(Continued)

OTHER PUBLICATIONS

Baig et al., "Architecture for Range, Doppler and Direction Finding Radar", J. Appl. Environ. Biol. Sci., vol. 4, No. 7S, 2014, pp. 193-198.
(Continued)

*Primary Examiner* — Justin M Benedik
(74) *Attorney, Agent, or Firm* — Christensen, Fonder, Dardi & Herbert PLLC

(57) ABSTRACT

A guided projectile having a nose portion, a body portion, a tail portion, and a central axis. In various embodiments the projectile includes a control support portion and a collar assembly pivotally mounted to the control support portion. In various embodiments the collar assembly includes a collar having an exterior sidewall with a plurality of fixed aerodynamic surfaces thereon for spinning the collar and a plurality of variable sweep wings for directional control of the projectile. In various embodiments the plurality of variable sweep wings each have a first end coupled to a wing actuator configured to rotate a second end portion between and including a first position, where the wings are oriented generally parallel to the central axis of the projectile to a second position, where the lengthwise wing axis of the plurality of wings are oriented generally perpendicular to the central axis of the projectile.

20 Claims, 16 Drawing Sheets

Related U.S. Application Data continuation of application No. 15/998,269, filed on Jul. 26, 2018, now abandoned.

(60) Provisional application No. 62/537,306, filed on Jul. 26, 2017.

(51) Int. Cl.
*F42B 10/54* (2006.01)
*F42B 30/10* (2006.01)

(56) References Cited

U.S. PATENT DOCUMENTS 2,687,482 A 8/1954 Harmon et al.
2,996,008 A 8/1961 Allen et al.
3,000,307 A 9/1961 Trotter, Jr.
3,111,080 A 11/1963 French et al.
3,111,088 A 11/1963 Fisk
3,233,950 A 2/1966 Baermann
3,598,022 A 8/1971 Maier
3,614,181 A 10/1971 Meeks
3,747,529 A 7/1973 Plattner
3,913,870 A 10/1975 Bolick
3,939,773 A 2/1976 Jenkins et al.
3,943,520 A 3/1976 Apstein et al.
4,044,682 A 8/1977 Karayannis
4,088,076 A 5/1978 Karayannis
4,176,814 A 12/1979 Albrektsson et al.
4,202,515 A 5/1980 Maxwell, Jr.
4,207,841 A 6/1980 Bloomer
4,267,562 A 5/1981 Raimondi
4,347,996 A 9/1982 Grosso
4,373,688 A 2/1983 Topliffe
4,379,598 A 4/1983 Goldowsky
4,438,893 A 3/1984 Sands et al.
4,512,537 A 4/1985 Sebestyen et al.
4,525,514 A 6/1985 Yachigo et al.
4,528,911 A 7/1985 DePhillipo et al.
4,537,371 A 8/1985 Lawhorn et al.
4,547,837 A 10/1985 Bennett
4,565,340 A 1/1986 Bains
4,568,039 A 2/1986 Smith et al.
4,664,339 A 5/1987 Crossfield
4,667,899 A 5/1987 Wedertz
4,815,682 A 3/1989 Feldmann et al.
4,860,969 A 8/1989 Muller et al.
4,898,342 A 2/1990 Kranz et al.
4,899,956 A 2/1990 King et al.
4,934,273 A 6/1990 Endriz
4,964,593 A * 10/1990 Kranz ..... F42B 10/64 244/3.23
5,043,615 A 8/1991 Oshima
5,101,728 A 4/1992 Frisk
5,125,344 A 6/1992 Kline et al.
5,126,610 A 6/1992 Fremerey
5,139,216 A 8/1992 Larkin
5,271,328 A 12/1993 Boulais et al.
5,321,329 A 6/1994 Hovorka
5,327,140 A 7/1994 Buckreub
5,381,445 A 1/1995 Hershey et al.
5,425,514 A 6/1995 Grosso
5,452,864 A 9/1995 Alford et al.
5,489,909 A 2/1996 Dittmann et al.
5,495,221 A 2/1996 Post
5,506,459 A 4/1996 Ritts
5,529,262 A 6/1996 Horwath
5,619,083 A 4/1997 Dunfield et al.
5,669,581 A 9/1997 Ringer
5,696,347 A 12/1997 Sebeny, Jr. et al.
5,725,179 A 3/1998 Gilman et al.
5,734,389 A 3/1998 Bruce et al.
5,747,907 A 5/1998 Miller
5,775,636 A 7/1998 Vig et al.
5,780,766 A 7/1998 Schröppel
5,788,178 A 8/1998 Barrett, Jr.
5,894,181 A 4/1999 Imlach
5,917,442 A 6/1999 Manoogian
5,932,836 A 8/1999 White
5,971,875 A 10/1999 Hill
5,982,319 A 11/1999 Borden et al.
5,986,373 A 11/1999 Stucker
6,020,854 A 2/2000 Jagnow et al.
6,052,647 A 4/2000 Parkinson et al.
6,126,109 A 10/2000 Barson et al.
6,135,387 A * 10/2000 Seidel ..... F42B 10/16 244/3.1
6,186,443 B1 2/2001 Shaffer
6,204,801 B1 3/2001 Sharka et al.
6,208,936 B1 3/2001 Minor et al.
6,227,820 B1 5/2001 Jarvik
6,234,082 B1 5/2001 Cros et al.
6,314,886 B1 11/2001 Kuhnle et al.
6,345,785 B1 2/2002 Harkins et al.
6,352,218 B1 3/2002 Holmqvist et al.
6,389,974 B1 5/2002 Foster
6,390,642 B1 5/2002 Simonton
6,398,155 B1 6/2002 Hepner et al.
6,422,507 B1 7/2002 Lipeles
D461,159 S 8/2002 Miralles et al.
6,493,651 B2 12/2002 Harkins et al.
6,502,786 B2 1/2003 Rupert et al.
6,588,700 B2 7/2003 Moore et al.
6,595,041 B2 7/2003 Hansen
6,629,669 B2 10/2003 Jensen
6,653,972 B1 11/2003 Krikorian et al.
6,666,402 B2 12/2003 Rupert et al.
6,693,592 B2 2/2004 Dowdle et al.
6,727,843 B1 4/2004 Hansen
6,796,525 B2 9/2004 Johnsson et al.
6,806,605 B1 10/2004 Gabrys
6,834,591 B2 12/2004 Rawcliffe et al.
6,842,674 B2 1/2005 Solomon
6,869,044 B2 3/2005 Geswender
6,882,314 B2 4/2005 Zimmerman et al.
6,889,934 B1 5/2005 Thomas et al.
6,923,404 B1 8/2005 Liu et al.
6,970,128 B1 11/2005 Dwelly et al.
6,981,672 B2 1/2006 Clancy et al.
7,015,855 B1 3/2006 Medl et al.
7,020,501 B1 3/2006 Elliott et al.
7,098,841 B2 8/2006 Hager et al.
7,174,835 B1 2/2007 Knapp
7,226,016 B2 6/2007 Johnsson et al.
7,267,298 B2 9/2007 Leininger
7,296,520 B1 11/2007 McMullen, Jr. et al.
7,305,467 B2 12/2007 Kaiser et al.
7,338,009 B1 3/2008 Bobinchak et al.
7,341,221 B1 3/2008 Wilson
7,354,017 B2 4/2008 Morris et al.
7,412,930 B2 8/2008 Smith et al.
7,422,175 B1 9/2008 Bobinchak et al.
7,431,237 B1 10/2008 Mock et al.
7,475,846 B2 1/2009 Schroeder
7,500,636 B2 3/2009 Bredy
7,548,202 B1 6/2009 Jennings
7,566,027 B1 7/2009 Johnson et al.
7,584,922 B2 9/2009 Bär et al.
7,626,544 B2 12/2009 Smith et al.
7,631,833 B1 12/2009 Ghaleb et al.
7,675,012 B1 3/2010 Bobinchak et al.
7,681,504 B2 3/2010 Machina et al.
7,701,380 B2 4/2010 Altes
7,781,709 B1 8/2010 Jones et al.
7,791,007 B2 9/2010 Harnoy
7,834,301 B2 11/2010 Clingman
7,849,797 B2 12/2010 Geswender et al.
7,849,800 B2 12/2010 Hinsdale et al.
7,900,619 B1 3/2011 Palmer et al.
7,947,936 B1 5/2011 Bobinchak et al.
7,963,442 B2 6/2011 Jenkins et al.
7,989,742 B2 8/2011 Bredy
7,999,212 B1 8/2011 Thiesen et al.
8,063,347 B1 11/2011 Urbano et al.
8,076,623 B2 12/2011 Dryer

(56) References Cited

U.S. PATENT DOCUMENTS

| | | | | |
|---|---|---|---|---|
| 8,113,118 | B2 | 2/2012 | Schmidt et al. | |
| 8,125,198 | B2 | 2/2012 | Steinbrecher | |
| 8,183,746 | B2 | 5/2012 | Rastegar | |
| 8,229,163 | B2 | 7/2012 | Coleman et al. | |
| 8,258,999 | B2 | 9/2012 | Rastegar et al. | |
| 8,288,698 | B2 | 10/2012 | Seidensticker | |
| 8,288,699 | B2 | 10/2012 | Romero et al. | |
| 8,319,162 | B2 | 11/2012 | Mccool | |
| 8,319,163 | B2 | 11/2012 | Flood et al. | |
| 8,319,164 | B2 | 11/2012 | Martinez | |
| 8,324,542 | B2 | 12/2012 | Frey, Jr. | |
| 8,344,303 | B2 | 1/2013 | Elgersma et al. | |
| 8,410,412 | B2 | 4/2013 | Geswender et al. | |
| 8,426,788 | B2 | 4/2013 | Geswender | |
| 8,471,186 | B2 | 6/2013 | Wallis | |
| 8,471,758 | B2 | 6/2013 | Samuel et al. | |
| 8,487,226 | B2 | 7/2013 | Biswell | |
| 8,508,404 | B1 | 8/2013 | Wilmhoff | |
| 8,519,313 | B2 | 8/2013 | Geswender et al. | |
| 8,552,349 | B1 | 10/2013 | Alexander | |
| 8,552,351 | B2 | 10/2013 | Geswender et al. | |
| 8,558,151 | B2 | 10/2013 | Seidensticker | |
| 8,669,505 | B2 | 3/2014 | Guibout et al. | |
| 8,674,277 | B2 | 3/2014 | Axford et al. | |
| 8,698,059 | B2 | 4/2014 | Nikkel et al. | |
| 8,701,558 | B2 | 4/2014 | Rastegar et al. | |
| 8,716,639 | B2 | 5/2014 | Mallon | |
| 8,748,787 | B2 | 6/2014 | Weiss et al. | |
| 8,757,064 | B2 | 6/2014 | Jennings et al. | |
| 8,812,654 | B2 | 8/2014 | Gelvin et al. | |
| 8,816,260 | B2 | 8/2014 | Hindman et al. | |
| 8,832,244 | B2 | 9/2014 | Gelvin et al. | |
| 8,836,503 | B2 | 9/2014 | Gelvin et al. | |
| 8,916,810 | B2 | 12/2014 | Geswender et al. | |
| 8,950,335 | B2 | 2/2015 | Strömberg et al. | |
| 8,993,948 | B2 | 3/2015 | Geswender et al. | |
| D729,896 | S | 5/2015 | Martinez | |
| 9,031,725 | B1 | 5/2015 | DiEsposti | |
| 9,040,885 | B2 * | 5/2015 | Morris | F42B 10/54 244/3.24 |
| 9,048,701 | B2 | 6/2015 | Lang | |
| 9,052,202 | B2 | 6/2015 | Riley | |
| 9,070,236 | B1 | 6/2015 | DiEsposti | |
| 9,071,171 | B2 | 6/2015 | Rastegar et al. | |
| 9,086,258 | B1 | 7/2015 | Vasudevan et al. | |
| 9,108,713 | B2 | 8/2015 | Tao et al. | |
| 9,187,184 | B2 | 11/2015 | Miralles et al. | |
| 9,194,675 | B1 | 11/2015 | Manole et al. | |
| 9,211,947 | B2 | 12/2015 | Miralles | |
| 9,303,964 | B2 | 4/2016 | Wurzel et al. | |
| 9,347,753 | B1 | 5/2016 | Horch et al. | |
| 9,360,286 | B2 * | 6/2016 | Pettersson | F42B 10/14 |
| 9,371,856 | B2 | 6/2016 | Kundel | |
| 9,410,783 | B1 | 8/2016 | Khuc et al. | |
| 9,557,405 | B2 | 1/2017 | Takahashi et al. | |
| 9,587,923 | B2 | 3/2017 | Wurzel et al. | |
| 9,644,929 | B1 | 5/2017 | Bradbury et al. | |
| 9,683,814 | B2 | 6/2017 | Dryer | |
| 9,709,372 | B2 | 7/2017 | Edwards | |
| 9,939,238 | B1 | 4/2018 | Sowle et al. | |
| 10,054,404 | B2 | 8/2018 | Balk et al. | |
| 10,203,188 | B1 | 2/2019 | Sowle et al. | |
| 10,288,397 | B2 | 5/2019 | Rastegar et al. | |
| 11,056,962 | B2 | 7/2021 | Kao | |
| 2001/0030260 | A1 | 10/2001 | Niemeyer et al. | |
| 2003/0076260 | A1 | 4/2003 | Ryken et al. | |
| 2004/0046467 | A1 | 3/2004 | Huang et al. | |
| 2004/0068415 | A1 | 4/2004 | Solomon | |
| 2004/0099173 | A1 | 5/2004 | Rector et al. | |
| 2004/0134337 | A1 | 7/2004 | Solomon | |
| 2005/0034627 | A1 | 2/2005 | Manole et al. | |
| 2006/0061949 | A1 | 3/2006 | Chen et al. | |
| 2008/0012751 | A1 | 1/2008 | Owens et al. | |
| 2008/0061188 | A1 | 3/2008 | Morris et al. | |
| 2008/0093498 | A1 | 4/2008 | Leal et al. | |
| 2008/0223977 | A1 | 9/2008 | Dryer | |
| 2008/0237391 | A1 | 10/2008 | Mock et al. | |
| 2010/0199873 | A1 | 8/2010 | Rastegar | |
| 2010/0213307 | A1 | 8/2010 | Hinsdale et al. | |
| 2010/0237185 | A1 | 9/2010 | Dryer | |
| 2010/0285721 | A1 | 11/2010 | Ma | |
| 2011/0032361 | A1 | 2/2011 | Tamir | |
| 2011/0094372 | A1 | 4/2011 | Carlson | |
| 2012/0068000 | A1 | 3/2012 | Goldner et al. | |
| 2012/0211593 | A1 | 8/2012 | Morris et al. | |
| 2013/0126612 | A1 | 5/2013 | Durkee | |
| 2013/0126667 | A1 | 5/2013 | Weiss et al. | |
| 2013/0126668 | A1 | 5/2013 | Chessel et al. | |
| 2014/0158814 | A1 | 6/2014 | Elkayam et al. | |
| 2015/0203201 | A1 | 7/2015 | Tao et al. | |
| 2015/0330755 | A1 | 11/2015 | Citro et al. | |
| 2016/0185445 | A1 | 6/2016 | Miralles et al. | |
| 2016/0347476 | A1 | 8/2016 | Xiao | |
| 2016/0252333 | A1 | 9/2016 | Carlqvist et al. | |
| 2017/0021945 | A1 | 1/2017 | Fisher et al. | |
| 2017/0023057 | A1 | 1/2017 | Li et al. | |
| 2017/0191809 | A1 | 7/2017 | Harris et al. | |
| 2017/0299355 | A1 | 10/2017 | Trouillot et al. | |
| 2018/0245895 | A1 | 8/2018 | Malul et al. | |
| 2019/0041175 | A1 | 2/2019 | Fellows et al. | |
| 2019/0041527 | A1 | 2/2019 | Gutafson | |
| 2019/0107374 | A1 | 4/2019 | Hill | |
| 2019/0302276 | A1 | 10/2019 | Sandford et al. | |
| 2020/0064112 | A1 | 2/2020 | Raml | |
| 2020/0292287 | A1 | 9/2020 | Thoren et al. | |

FOREIGN PATENT DOCUMENTS

| | | | | |
|---|---|---|---|---|
| EP | 2165152 | | 8/2014 | |
| EP | 3671102 | A1 * | 6/2020 | F42B 10/60 |
| GB | 2547425 | | 8/2017 | |
| WO | WO2007058573 | | 5/2007 | |

OTHER PUBLICATIONS

Bekmezci et al, "Flying Ad-Hoc Networks (FANETs): A Survey", posted on the Internet at elsevier.com/locate.adhoc; Jan. 8, 2013, published by Elsevier, Amsterdam, The Netherlands; 17 pages.

Costanzo et al., "High Resolution Software Defined Radar System for Target Detection", Journal of Electrical and Computer Engineering, vol. 2013, Article ID 573217, 2013, 8 pages.

Kwag et al., "Modern Software Defined Radar (SDR) Technology and Its Trends", Journal of Electromagnetic Engineering and Science, vol. 14, No. 4, Dec. 2014, pp. 321-328.

Zhang, B. et al. Mechanical Construction and Analysis of an Axial Flux Segmented Armature Torus Machine, International Conference on Electrical Machines, Sep. 2-5, 2014, pp. 1293-1299.

Zou, T. et al., "Analysis of a Dual-Rotor, Toroidal-Winding, Axial-Flux Vernier Permanent Magnet Machine", Institute of Electrical and Electronics Engineers, May/Jun. 2017, vol. 53, No. 3, pp. 1920-1930.

* cited by examiner

DESPUN WING CONTROL SYSTEM FOR GUIDED PROJECTILE MANEUVERS

CROSS-REFERENCE TO RELATED APPLICATIONS

The present application is a continuation of U.S. patent application Ser. No. 18/107,554, filed Feb. 9, 2023, which is a continuation of U.S. patent application Ser. No. 15/998,269, filed Jul. 26, 2018, abandoned, which claims the benefit of U.S. Provisional Application No. 62/537,306, filed Jul. 26, 2017, the entire contents of which are incorporated by reference herein.

TECHNICAL FIELD

The present disclosure relates to guided projectiles, and more specifically, to a guidance system for guided artillery projectiles and guided mortar projectiles.

BACKGROUND

Delivery errors are known to significantly degrade the effectiveness of barrel fired projectiles, such as shells, bullets, or other projectiles. As such, extensive efforts have been directed toward guiding or steering such projectiles after they have been fired to compensate for delivery errors, thereby improving operational efficiencies and the likelihood of target engagement. In certain applications, such steering may be necessary for providing any reasonable probability of engaging a target, particularly for moving targets or targets that can take evasive action. Such projectile steering also minimizes collateral damage, conserves ammunition, reduces costs, and minimizes personnel time in engaging targets.

Artillery and other projectiles, have been successfully guided utilizing systems such as shown in U.S. Pat. No. 6,981,672, owned by the owner of the instant application. Artillery shells utilizing the designs of this patent have been well received by the military. For example, see U.S. Pat. No. 7,412,930. These patents are incorporated herein by reference in their entirety for all purposes.

These artillery projectiles are generally fired from a conventional rifled barrel which imparts a spin generally around 800 KHz. A forward nose portion is rotatable with respect to a body of the artillery projectile. Aero-surfaces on the nose portion provide a rotational force counter to the spin direction of the body to despin the nose portion. Additional aero-surfaces configured as radially outwardly extending canards on the despun nose portion may then be positioned at a particular rotational position to impart a lateral force to the nose portion of the projectile thereby altering its flight trajectory.

These nose portions are effective for modest course corrections to the flight of the artillery projectile and provide power generation for the control circuitry. Although the rotating nose portion with the aero-surfaces provide increased drag to the projectile, such drag does not significantly inhibit the performance of the artillery round for the modest course corrections due to the weight of the projectile and the normal arcuate projectile flight with targets being located on the ground.

Guided missiles have long been utilized for targeting aircraft and may be self-guided or remotely guided. See, for example: U.S. Pat. No. 3,111,080, incorporated herein by reference in its entirety for all purposes. Such missiles are typically not spun, have internal propulsion systems, and rely upon fins and radially extending flaps or propulsion directing members for altering flight path. Guided missiles have their own propulsion systems and need to be launched or fired from launch tubes or brackets designed specific to the missile. Due to the propulsion systems, missiles are substantially more expensive than non-propelled projectiles.

With respect to medium and large caliber projectiles, greater than 50 caliber, several solutions have been proposed utilizing movable aerodynamic surfaces for steering. For example, U.S. Pat. No. 6,422,507, incorporated herein by reference in its entirety for all purposes, discloses a greater than 50 caliber projectile that may be fired from a conventional barreled gun. This projectile utilizes a spoiler that extends and retracts from a rearwardly positioned despun portion out into the air stream. The despun portion is despun by a motor and batteries are disclosed as providing power to the bullet. The structure depicted and described does not have features configured for the operative portions, particularly the flight control mechanisms, to survive high G firings needed for extended effective range of non-propelled projectiles and to minimize drag.

Several solutions to guiding small caliber projectiles, that is 50 caliber or less, have been proposed. These include firing the projectile without spinning the projectile and utilizing axially extending control fins for altering the flight. See for example, U.S. Pat. No. 7,781,709, incorporated herein by reference in its entirety for all purposes. A notable disadvantage to such projectiles is that they cannot be fired from existing rifled barrels for conventional non steerable projectiles and require internal batteries for operating the control circuitry and control fins which may affect the useful life of the projectile and provides a failure path. U.S. Pat. No. 5,788,178, incorporated herein by reference in its entirety for all purposes, also discloses a small caliber bullet that is designed to be fired from a non-rifled barrel. Deployable flaps are utilized controlling the flight path in the '178 device and the device requires a battery.

U.S. Pat. No. 8,716,639 discloses small to medium caliber projectiles fired through a rifled barrel that use beveled surfaces or canards on a despun nose portion operated by a motor and battery for flight control. U.S. Pat. No. 4,537,371 discloses a projectile fired through a barreled projectile that distributes air from the air stream through the projectile with valves to discharge the air laterally to change the flight path. These references are incorporated herein by reference in their entirety for all purposes.

Additionally, it is generally understood in the art that minimal drag is conducive to maximum range for non-propelled projectiles. Impeding the air stream passing a projectile for purposes of despinning portions of projectiles or for flight control surfaces adds drag and reduce the effective range of such projectiles. Thus, aspects of the prior art generally find it desirable to minimize the drag of such aerodynamic surfaces.

For all types and sizes of such steered projectiles, elements necessarily include control/operation circuitry, on-board power supplies, and flight control mechanisms. As described, in most cases such flight control mechanisms will constitute movable aero dynamic control surfaces, such as fins, wing-like projections, or canards that engage the air stream.

Additional prior guidance systems utilizing fins, wing-like projections, or canards have been proposed. See for example the following U.S. patents: U.S. Pat. Nos. 4,373,688; 4,438,893; 4,512,537; 4,568,039; 5,425,514; 5,780,766; 6,314,886; 6,502,786; 7,354,017; 7,849,800; 8,319, 164; and 9,086,258. These patents are incorporated herein by reference in their entirety for all purposes.

Further improvements are always welcome for steerable projectiles that enhance accuracy, allow miniaturization, increase range, provide cost savings, or improve reliability of guided ammunition.

SUMMARY

One or more embodiments of the disclosure are directed to a guided projectile including a despun or spun portion with a plurality of deployable wings with a variable wing sweep. In various embodiments the projectile includes a chassis extending from a tail portion to a nose portion. In various embodiments the projectile further includes a control support portion extending axially from the nose portion and a flight control portion in the form of a collar assembly pivotally mounted to the control support portion. In one or more embodiments, the collar assembly is forwardly positioned in the projectile, forward of the main body portion and adjacent to the nose portion.

In various embodiments the collar assembly includes a collar, pivotally mounted to the control support portion, having a circumferentially and axially extending exterior sidewall with a plurality of fixed aerodynamic surfaces thereon for despinning or spinning the collar about the control support portion. As used herein, the terms "despun", "despin", "despinning", or other variant of the term, refers to an object that is spun in a direction about its longitudinal axis that, in some instances, is counter-rotational with another portion of the projectile. However, the terms also include objects that are the only spun or spinning portion of the projectile. For example, in some instances a despun collar refers to a collar that is spinning about its longitudinal axis while a remainder of the projectile has a 0 Hz rotational motion, relative to the earth. As such, the terms "despun" and "spun" or variant of either of these terms are used interchangeably herein.

In addition, in certain embodiments, the collar includes the plurality of variable sweep wings pivotally mounted to an interior portion of the collar. In various embodiments the collar assembly and the plurality of variable sweep wings are configured for projectile range extension and for directional control of the projectile. For example, in one or more embodiments the plurality of variably sweep wings are outwardly deployable from the interior of the collar to a plurality of positions for generating projectile lift and for generally extending the glide slope of the ballistic trajectory of the projectile. In addition, in various embodiments, when deployed, the plurality of wings are easily and quickly rotated about the control support portion, via the rotatable collar, to provide lift force on the projectile allowing for efficient band-to-turn maneuvering control.

In addition, in one or more embodiments, the plurality of wings have a configurable wing sweep angle between a longitudinal wing axis and the central axis of the projectile. In various embodiments the wing sweep angle can be controlled or adjusted during flight to improve projectile accuracy, range, maneuvering, extend the glide slope for the ballistic trajectory of the projectile and to reduce projectile drag.

As such, in certain embodiments, the projectile is configured to adjust or control the wing sweep angle of the wings into one or more optimal or preferred positions for different phases of the projectile's flight. In one or more embodiments, the flight phases include, but are not limited to, a ballistic phase, a guidance phase, and a terminal guidance phase. In certain embodiments, the wing sweep is adjustable in each of the phases between a low drag position, a high lift to drag ratio position, and a high lift/high maneuverability position. In various embodiments wing sweep angle control is achieved using an actuator embedded in the de-spun collar and coupled to each of the plurality of wings.

In addition, various embodiments can realize these benefits with non-traditionally guided projectiles such as artillery rounds, which are not generally considered for implementation with guidance systems due to their weight. For example, in one or more embodiments the collar assembly and the plurality of wings are forwardly mounted on the projectile, allowing for dramatic and quick course changes in spite of the weight of the projectile. In addition, adding guidance capability to the forward portion of the projectile is highly desirable because it can be used to retrofit legacy hardware, such as by replacing traditional fuse systems at the nose of the projectile. In addition, one or more embodiments are fully scalable to various firing platforms, including, including the M777 and the US Navy's Mk 45 5-inch gun, or other rifled gun. In certain embodiments, guidance capacity is provided for both mortar and artillery systems, such as and including 120 mm mortars and 155 mm artillery shells.

Further, various embodiments avoid problems resulting from several known projectile guidance systems which generally require a substantial volume in the projectile, occupying space in the projectile traditionally reserved for ordinance, and/or add significant cost to the fuse. As such, various embodiments of the present disclosure provide a relative simple guidance system which fits within the existing package volume of a projectile and which is relatively inexpensive compared to prior guidance systems for artillery projectiles.

In addition, various embodiments provide a projectile control system with improved performance, maneuverability, and reliability to meet the challenging range, accuracy, cost, and reliability requirements of various governmental munition acquisition programs. As such, various embodiments provide a projectile control system to satisfy multiple requirements for extended-range guided munitions by providing flight control for low drag, high lift-over-drag ratio (L/D), and high maneuverability with minimal complexity.

For example, typical high lift/drag ratio gliders rely on large wings with elevator, rudder, and aileron control, or other actuated subcomponent of the wings, requiring multiple actuatable portions or sub-components of the flight control system. These existing control mechanisms are significantly more costly and complex relative to embodiments of the disclosure. In addition, various embodiments provide a simplified and cost effective alternative to other forms of gliding projectiles, such as boosted projectiles with a rocket motor or other propulsion systems.

As such, one or more embodiments are directed to a guided projectile with variable sweep wings. In one or more embodiments, the plurality of variable sweep wings each have a first end portion pivotally mounted to an interior of the collar and are coupled to a wing actuator configured to rotate a second end portion outwardly from the sidewall of the collar to a plurality of positions between and including a first position, where the wings are oriented having a lengthwise wing axis generally parallel to the central axis of the projectile and a second position, where the wings are oriented having the lengthwise wing axis of the plurality of wings generally perpendicular to the central axis of the projectile.

The above summary is not intended to describe each illustrated embodiment or every implementation of the present disclosure.

BRIEF DESCRIPTION OF THE SEVERAL VIEWS OF THE DRAWINGS

The drawings included in the present application are incorporated into, and form part of, the specification. They illustrate embodiments of the present disclosure and, along with the description, serve to explain the principles of the disclosure. The drawings are only illustrative of certain embodiments and do not limit the disclosure.

FIGS. 1-5A depict side views and cross sectional views of a guided projectile according to one or more embodiments of the disclosure.

Figure 1:
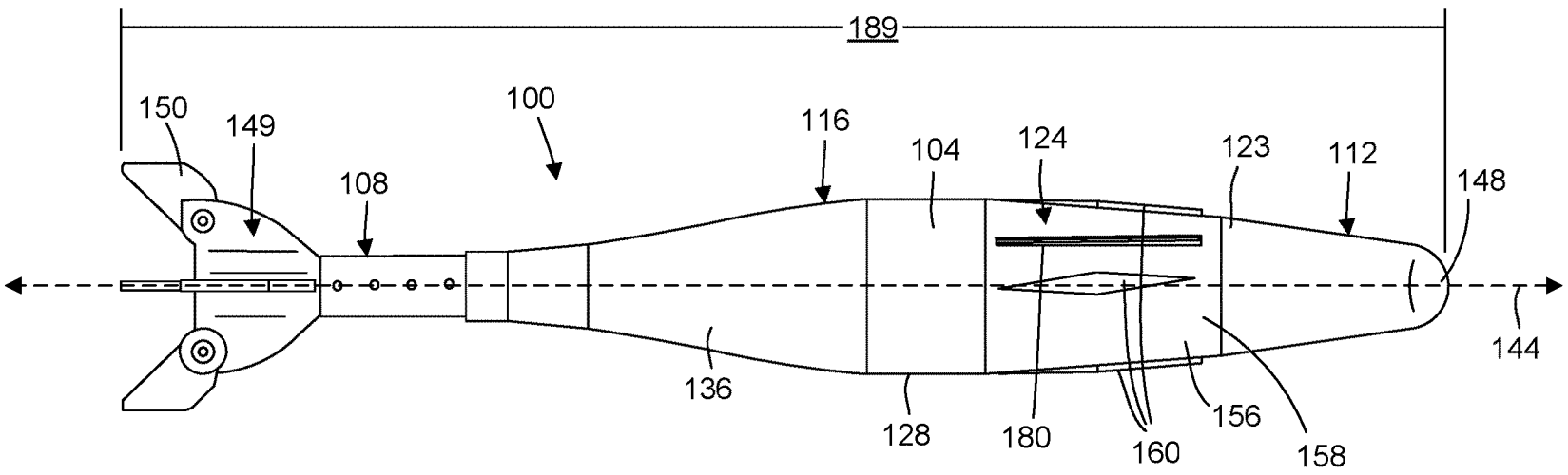

While the embodiments of the disclosure are amenable to various modifications and alternative forms, specifics thereof have been shown by way of example in the drawings and will be described in detail. It should be understood, however, that the intention is not to limit the disclosure to the particular embodiments described. On the contrary, the intention is to cover all modifications, equivalents, and alternatives falling within the spirit and scope of the disclosure.

DETAILED DESCRIPTION

FIGS. 1-7 depict side views, a front view, and cross sectional views of a guided projectile 100 according to one or more embodiments of the disclosure.

In one or more embodiments, the projectile 100 includes a main body portion 104, a tail portion 108, and a nose portion 112. A chassis 116 extends from the nose portion 112, defines the main body portion 104, and extends to the tail portion 108. The chassis 116 is, in some embodiments, machined or formed from a single block of metal. In some embodiments, the chassis 116 includes a control support portion 120 for supporting a collar assembly 124, which is discussed further below.

In one or more embodiments, the main body portion 104 provides a structure for containing and/or supporting various elements of the projectile 100 including payload and/or operational components. For example, in various embodiments the main body portion 104 includes payload 117. In certain embodiments payload 117 can include any suitable type of munition, explosive, or other substance based on the purpose of the projectile and/or preferences of a user. In some embodiments payload 117 could include other items or cargo deployed via the projectile 100. For example, the payload 117 could include kinetic projectiles, one or more automated drones, or self-contained munitions that could be deployed as a group or swarm. In certain embodiments, main body portion 104 could additionally include various components for internal power generation, communication, sensing, processing, or for other functions.

In certain embodiments, the main body portion 104 has a cylindrical shape or a generally cylindrical shape with one or more tapered portions defined by a main body sidewall 128. In some embodiments, the main body sidewall 128 may be part of the chassis 116 as illustrated, or there may be an additional wall or surface exterior of the chassis 116.

In some embodiments, the main body sidewall 128 includes a tapered portion that converges in a direction along a central axis 144. For example, in some embodiments a rearward portion 136 of the main body sidewall 128 converges in a rearward direction, along central axis 144, from a mid-portion of the body portion towards the tail portion 108. Similarly, in some embodiments, a forward portion of some or all of the main body sidewall 128 could converge in a forward direction towards the nose portion 112.

In one or more embodiments the chassis 116 defines the control support portion 120. In various embodiments, the control support portion 120 is a structure that is unitary or integral with the chassis 116 for supporting various components of the projectile 100. In one or more embodiments, the control support portion 120 includes an axially projecting central stub portion 122 for supporting the collar assembly 124 and other elements of the projectile 100.

Figure 3:
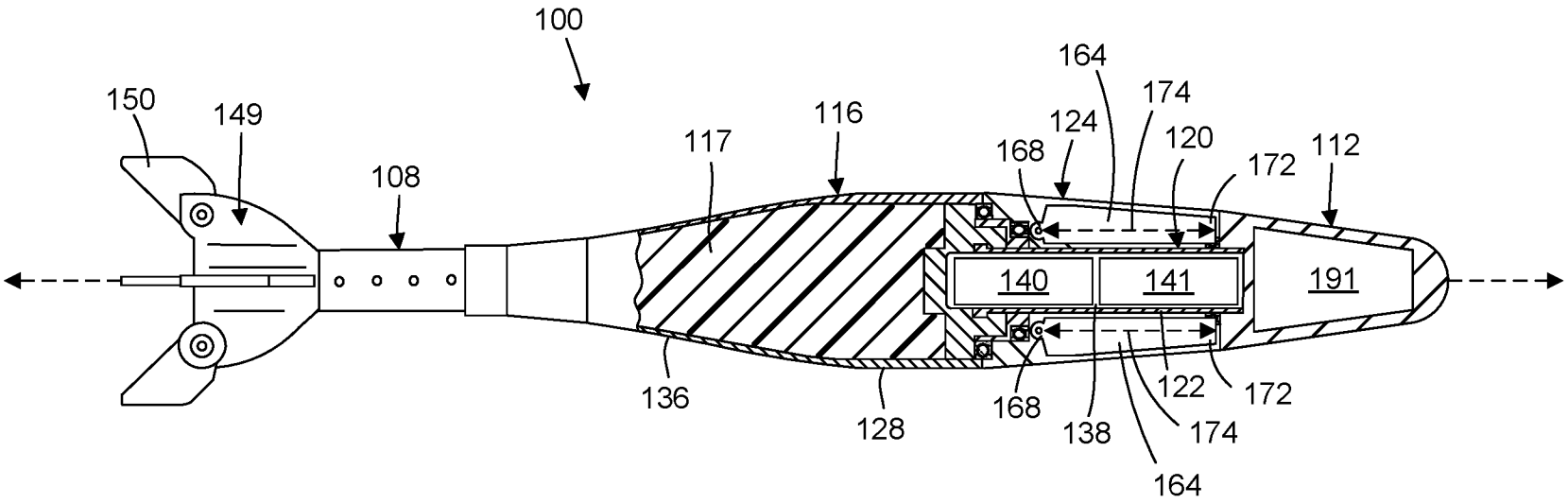
Figure 6:
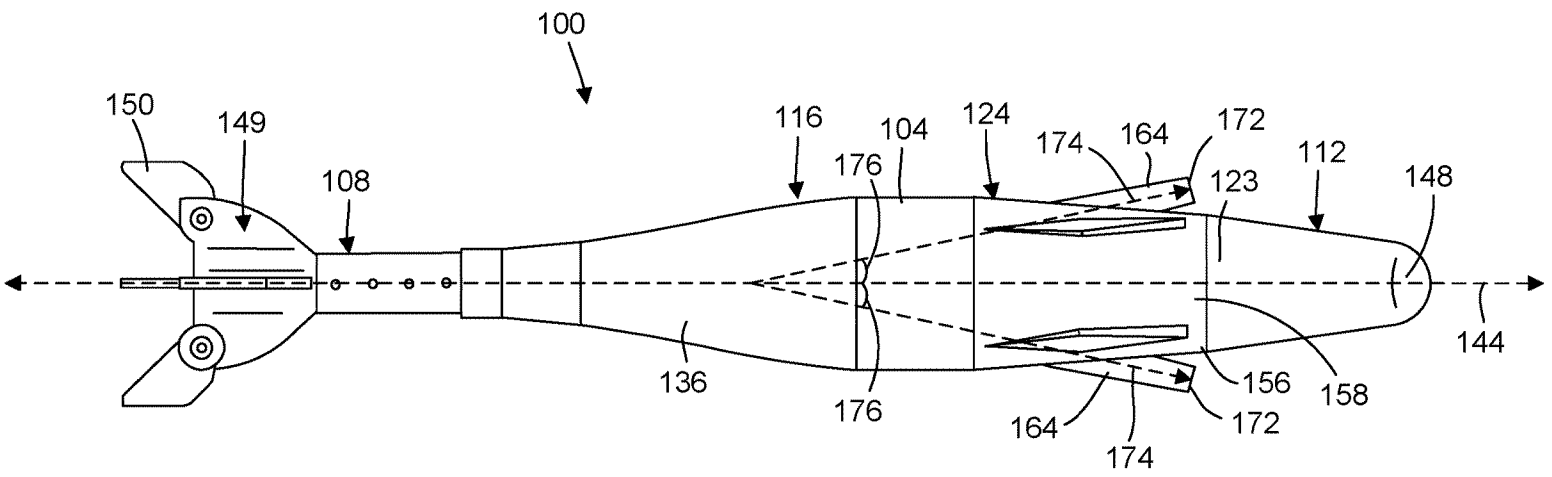
FIGS. 6-7 depict side views and cross sectional views of a guided projectile according to one or more embodiments of the disclosure.
Figure 7:
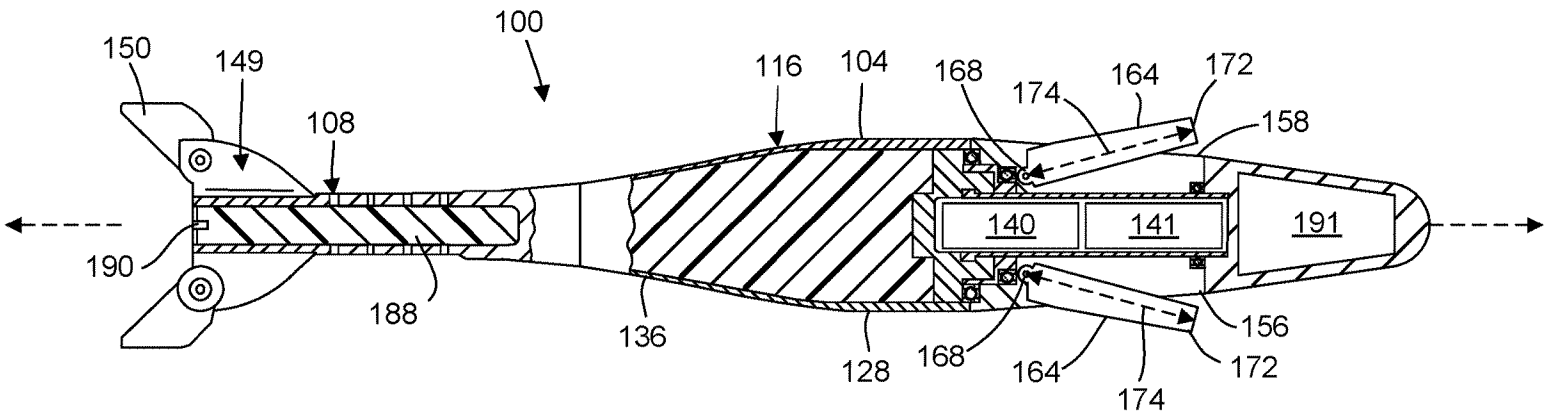

Depicted in FIGS. 3, 6, and 7, the central stub portion 122, is positioned intermediate the main body portion 104 and the nose portion of the projectile 100, extending axially from the nose portion 112 to the main body portion 104. In various embodiments, the central stub portion 122 is a tubular, or otherwise hollow structure with an outer wall that defines an interior space 138 for supporting various elements of the projectile 100. For example, in one or more embodiments the central stub portion 122 supports components 140 configured for internal power generation and/or rotational braking of the collar. In certain embodiments, the central stub portion 122 includes components 141 configured for communication, sensing, processing, or for other functions of the projectile 100. In various embodiments, additional or alternative components of the projectile 100 may be located within the interior space 138 defined by the control support portion 120.

The nose portion 112 is a forward facing (e.g. in the first direction) structure and has a tapered or a converging shape. For example, the nose portion 112 tapers from a rearward portion 123, forwardly, in a first direction along the central axis 144 to a forward tip portion 148. In various embodiments, nose portion 112 may be conical or have a curved taper or other taper to generally define an ogive shape for the projectile 100.

The tail portion 108 is a rearwardly extending structure extending axially from the main body portion 104. In various embodiments tail portion 108 includes a stabilizing fin portion 149 having a plurality of fins 150 extending radially from the central axis 144. As such, in various embodiments projectile 100 is fin stabilized for flight via the plurality of fins 150 and tail portion 108.

As used herein, the term "fin-stabilized" refers to a projectile that obtains stability through the use of fins located at the aft end or at other suitable portion of the projectile. The fins interact with oncoming air during projectile flight to keep the projectile resistant to destabilizing torque in flight. In various instances, the term "fin-stabilized" includes projectiles having some amount of low-rate spin. For example, some fin-stabilized projectiles may be spun about their longitudinal axis at a relatively low rate of rotation to compensate for mass and/or configurational asymmetries from material imperfections, manufacturing tolerances, or from other sources.

The term "spin-stabilized", as used herein, means that the projectile is stabilized by being spun around its longitudinal (forward to rearward) central axis. The spinning mass creates gyroscopic forces that keep the projectile resistant to destabilizing torque in-flight. In addition, as used herein, the term "spin-stabilized" means that the projectile has a gyroscopic stability factor of 1.0 or higher. As such, while some projectiles, such as fin-stabilized projectiles, may have some amount of spin imparted on them during flight, the term "spin-stabilized" applies only to projectiles having a spin-rate such that the quantified gyroscopic stability factor achieves a value of 1.0 or higher.

In one or more embodiments, portions of the collar assembly 124 are pivotally mounted to the control support portion 120 and are independently rotatable for despinning with respect to the chassis 116, the main body portion 104, the nose portion 112, and the control support portion 120. For example, in one or more embodiments, the components of the collar assembly 124 includes a flight control portion in the form of a collar 156 pivotally mounted to the control support portion 120.

In one or more embodiments, the collar 156 includes a plurality of aerodynamic control surfaces and structures disposed on and raised with respect to an exterior wall 158 of the collar 156. For example, as seen in FIGS. 1, 2, 4, and 6, collar 156 includes a plurality of fins or strakes 160 disposed on the exterior wall 158. In various embodiments strakes 160 extend axially and are canted at an angle with respect to the central axis 144 such that the strakes 160 are configured to provide a rotational force or torque about the central axis 144 when the projectile 100 is traveling through the air. As such, in various embodiments, the rotational force or torque provided by the strakes 160 functions to despin the collar 156 during certain portions of the projectile's 100 flight.

In one or more embodiments, the strakes 160 and/or other aerodynamic control surfaces are within the axial envelope of the projectile 100 provided by the main body portion 104. As such, in various embodiments, the strakes 160 and/or other aerodynamic control surfaces provide minimal drag while still functioning to despin the collar 156 during flight. For example, in certain embodiments, the collar 156 has a tapered shape where the collar 156 tapers forwardly towards the nose portion 112 and the aerodynamic control surfaces, such as strakes 160, are defined by the recessed or tapered exterior sidewall 158 of the collar 156. Put another way, in certain embodiments the strakes 160 and/or other aerodynamic control surfaces are defined by recesses in the collar 156 whereby the outwardly most extending aerodynamic surfaces do not extend radially outward beyond the projectile 100 envelope.

In one or more embodiments, the collar assembly 124 includes a plurality of variable sweep wings 164. In various embodiments each of the plurality of wings 164 are an elongated wing-shaped structure having a body extending between a first end portion 168 and a second end portion 172 along a longitudinal wing axis 174. In various embodiments, the first end portion 168 of each of the wings 164 are pivotably or rotationally mounted to an interior of the collar 156 and are operably coupled with a wing actuator configured to rotate the wings 164 about the first end portion 168 between one or more of a variety of rotational positions. In various embodiments the collar 156 includes a plurality of slot or wing-shaped apertures 180 defined in the exterior surface 158 of the collar 156 and aligned with each of the wings 164 to allow outward deployment or rotation of each of the wings 164. In various embodiments the first end portion 168 of the wings 164 is positioned at or forward of a center of mass of the projectile 100. As such, described further below the wings 164 provide a lift force that is positioned at or near the center of mass of the projectile 100 for more efficient maneuvering in flight.

In one or more embodiments, each of the wings 164 are canted at a fixed angle relative to the central axis 144. For example, referring to FIG. 5A, a front view of the projectile 100 is depicted showing canted wings 164 having a front edge or leading edge raised higher than a tailing edge to provide an angled or canted surface for generating a lifting force or maneuvering torque on the projectile 100, described further below.

In some embodiments, the wings 164 are canted at the same angle as strakes 160. However in other embodiments the wings 164 can be canted at various fixed angles based on the preference of a user. Described further below, in various embodiments the canted angle of the wings 164 is used to generate a torqueing force or maneuvering torque on the projectile 100 to perform various turns or other maneuvers. For example, in certain embodiments, the rotation of the collar 156 is braked to stop or orient the canted wings 164 in various orientations to generate a specific maneuvering torque on the projectile 100.

In addition, in one or more embodiments the wings 164 each have a wing length 196. In various embodiments the wing length 196 is designed such that it corresponds to the diameter 198 of the projectile 100. For example, in some embodiments the wing length 196 is between 66% to 100% of the diameter 198 of the projectile 100. In certain embodiments wings 164 half-span (e.g. the length of the wing on one side) are between and including 40%-60% of the body of the projectile 100. In some embodiments, wing length 196 will vary depending on the range requirement for the projectile 100. For example, in certain embodiments longer wings will provide additional range for the projectile 100 in comparison to shorter wings.

Figure 2:
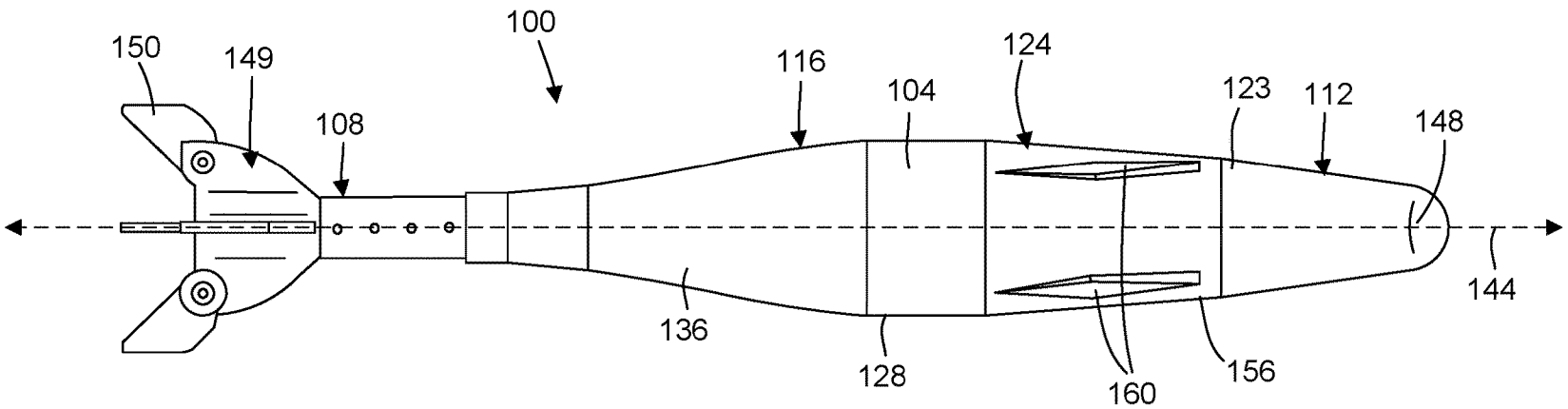

For example, depicted in FIGS. 1-3, the plurality of variable sweep wings 164 are configured in a first rotational position or stowed position, where the longitudinal wing axis 174 is generally oriented parallel to the central axis 144. In certain embodiments, when in the stowed position, the wings 164 are located substantially within the interior of the collar 156. For example, as depicted in FIGS. 1-3, the wings 164 are positioned such that no portion of the wings 164 extends beyond the outer envelope of the collar 156.

Figure 4:
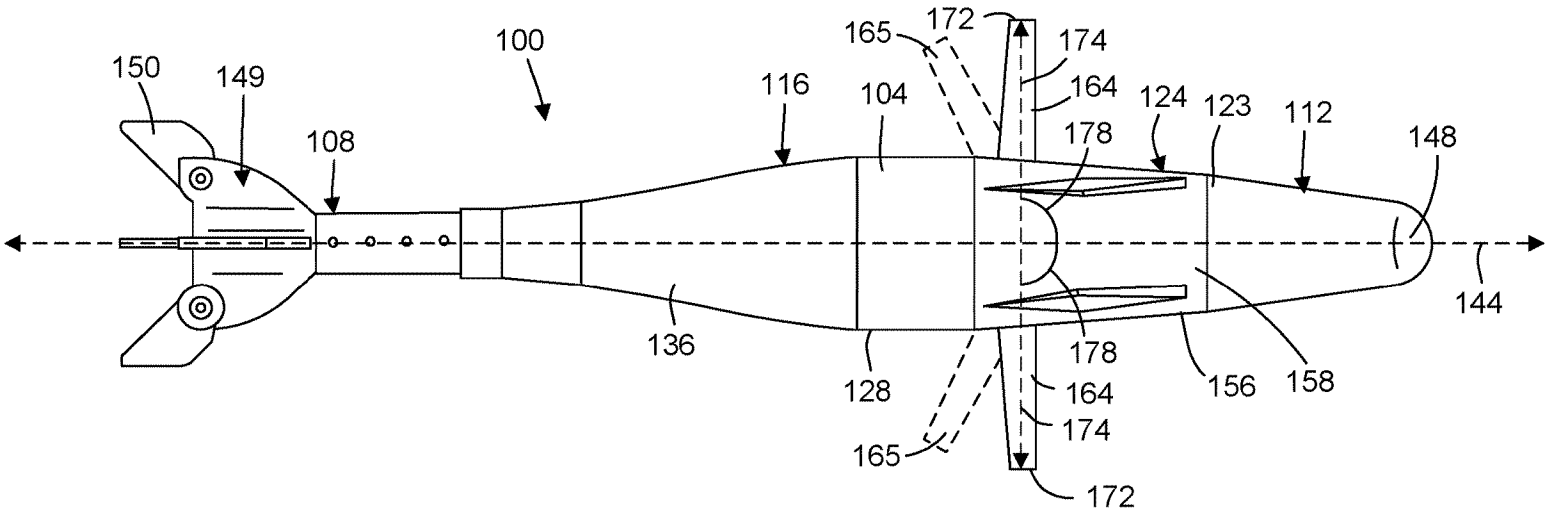
Figure 5A:
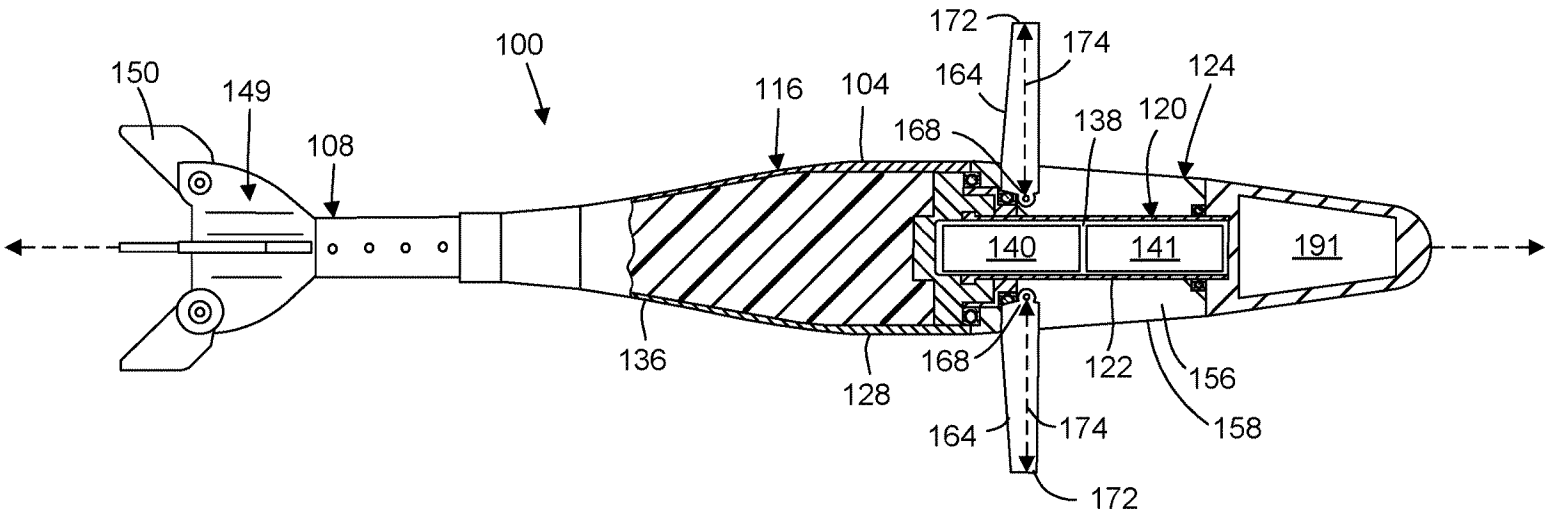
Figure 5B:
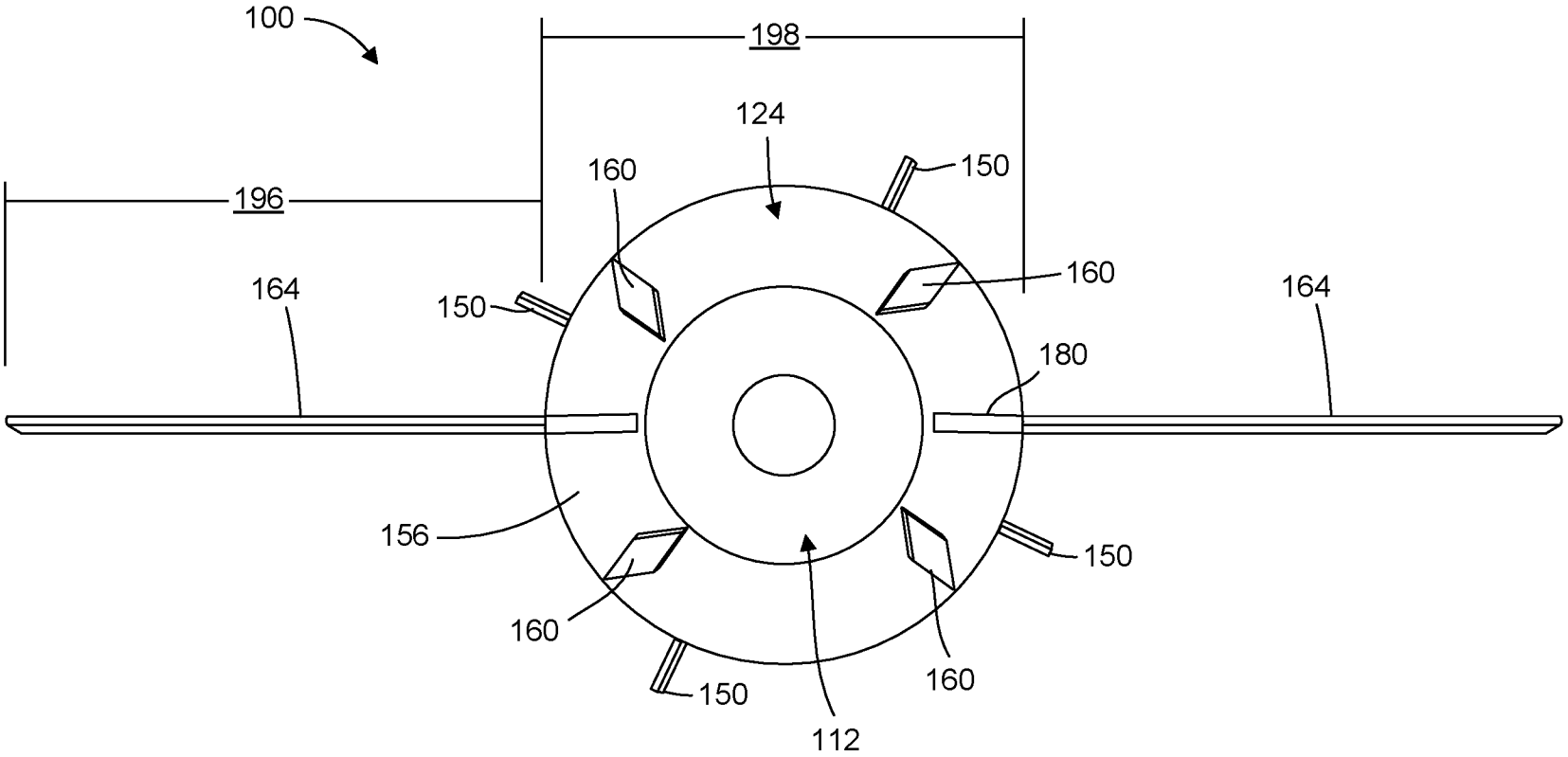
FIG. 5B depicts a front elevation view of a guided projectile according to one or more embodiments of the disclosure.

Depicted in FIGS. 4-5B, the plurality of wings 164 are configured in a second rotational position, or fully deployed position, where the longitudinal wing axis 174 is generally oriented perpendicular with the central axis 144. In various embodiments, the wings 164 are deployed or configured into the second position via the wing actuator coupled with each of the wings 164. For example, depicted in FIGS. 1-7, the wing actuator is configured to rotate the wings 164 about the first end portion 168 thereby rotating the second end portion 172 outwardly from the exterior sidewall 158 and axially rearwardly, towards the tail portion 108. However, in certain embodiments, such as where projectile 100 is configured for an air-dropped deployment, the plurality of wings 164 can be configured to be manually deployed into the second position. In such embodiments the wings 164 could be configured to be deployed by mechanical during deployment or manually by a user prior to launch.

In certain embodiments this rotation of the wings 164 could be reversed, where the first end portion 168 is rotatably or pivotally mounted in the collar 156 substantially adjacent to the nose portion 112 and where the wing actuator is configured to deploy the wings 164 by rotating the second end portion 172 of the wings 164 outwardly from the exterior sidewall 158 and forwardly towards the nose portion 112. In addition, while the first end portion 168 is depicted as rotatably mounted in the collar 156, in certain embodiments the second end portion 172 or other portion of the wings 164 could be rotatably mounted in the collar 156.

Depicted in FIGS. 6-7, the plurality of wings 164 are configured in a third rotational position, or partially deployed position, where the longitudinal wing axis 174 is generally oriented at a wing sweep angle 176 with the longitudinal axis 174 that is an acute angle. Put another way, in the third rotational position the plurality of wings 164 are oriented between the first position and the second position such that longitudinal wing axis 174 is neither generally parallel nor perpendicular with the central axis 144.

In various embodiments, the third position or partially deployed position includes any configuration where the wing sweep angle 176 of the wings 164 is an acute angle. However, in other embodiments the wings 164 are configurable into additional positions (e.g. a fourth position, fifth position, etc.) where the third position includes some portion of orientations where the wing sweep angle 176 is an acute angle and the additional positions include a remainder of positions where the wing sweep angle 176 is an acute angle.

In various embodiments, the wings 164 are deployed or configured into the third position via the wing actuator coupled with each of the wings 164. In addition, in various embodiments the wings 164 can be configured to the third position or partially deployed position from either the first position or the second position, as described above. For example, in various embodiments the wing actuator is configured to rotate the second end portion 172 to move the second end portion 172 axially either rearwardly or forwardly into the third position from the first position or second position, respectively. As described above, in certain embodiments, such as where projectile 100 is configured for an air-dropped deployment, the plurality of wings 164 can be configured to be manually deployed into the third position. In such embodiments the wings 164 could be configured to be deployed by mechanical during deployment or manually by a user prior to launch.

In one or more embodiments the wing actuator is a motor or other actuator mechanically coupled with the wings 164 via toothed gears, or other suitable means for rotating the wings 164. In various embodiments, the collar 156 includes a single wing actuator operably coupled with each of the plurality of wings 164, reducing design complexity, cost, and potential points of failure in the projectile 100. In addition, in various embodiments the single wing actuator improves simultaneous action or rotation of each of the wings 164 thereby improving overall projectile 100 flight performance.

In various embodiments, the wing actuator is configured to rotate the wings 164 between one or more rotational positions to alter or configure the wings 164 into having a different wing sweep with respect to the projectile 100. As used herein, wing sweep refers to an angle between the longitudinal wing axis 174 and the central axis 144 of the projectile 100. For example, in the first position or stowed position, the wings 164 have a wing sweep of approximately zero, as the longitudinal wing axis 174 and the central axis 144 are generally parallel. In the second position or fully deployed position, the wing sweep is approximately ninety degrees, as the longitudinal wing axis 174 and the central axis 144 are generally perpendicular. For example, depicted in FIG. 4, the wings 164 have a wing sweep angle 178 of approximately ninety degrees. Additionally, in the third position or partially deployed position the wing sweep is approximately the same as the wing sweep angle 176.

In addition to the above, in some embodiments, the wings 164 can be rotated or pivoted past the second position to a swept back position depicted in FIGS. 4-5A by dashed wing outlines 165. As such, in various embodiments the wings 164 can have a wing sweep angle with the longitudinal axis that is an obtuse angle, or greater than 90 degrees for gliding or for other maneuvers with a generally reduced wing sweep.

As described above, in certain embodiments the collar assembly 124 may include components 140, 141, for generating power or electricity in the projectile 100. In some embodiments the components 140, 141 include a ring cluster of magnets aligned with a corresponding ring of armature coils, a hydraulic pump electricity generating means, or other power generating components. In some embodiments, the collar assembly 124 includes a battery or other power storage components.

Projectiles with a collar assembly having internal components are discussed in further detail in U.S. patent application Ser. No. 15/290,755 entitled "Extended Range Medium Caliber Steerable Projectile", which is incorporated by reference in its entirety.

As depicted in FIGS. 1-7, in one or more embodiments, the control support portion 120 and collar assembly 124 are forwardly mounted on the projectile 100, forward of the main body portion 104 and payload 117. As such, in various embodiments collar assembly 124 is positioned forward of at least 50% of the total length 189 of the projectile 100. In certain embodiments, the collar assembly 124 is positioned forward of at least 66% of the total length of the projectile 100. In certain embodiments the collar assembly 124 control support portion 120 and nose portion 112 can be a single assembly that is attachable to the main body portion 104 of the projectile. In various embodiments, the single assembly is a fuse assembly where the collar assembly includes power generation, processing, sensors, wings 164 for guidance, and other components and the nose portion includes components 191 including a fuse for payload 117 detonation and/or other components. In certain embodiments the fuse assembly can be removably attached to various projectiles, such as projectile 100, in lieu of traditional fuses, to retrofit non-guided projectile with guidance capability.

While the various embodiments described and shown in the figures refer to a projectile 100 and a collar assembly 124, these elements can be referred to as a munition and munition assembly, respectively.

In operation, the projectile 100 can be loaded into a projectile firing platform, such as a mortar tube, or other launch tube, and fired. In one or more embodiments, the projectile firing platform may be a smooth-bore barrel. As such, in various embodiments the projectile 100 may be fired without an initial spin rate imparted by the barrel. In such embodiments, the projectile 100 may be primarily fin stabilized using fins 150 of the stabilizing fin portion 149 and/or the plurality of wings 164, described further below. For example, in various embodiments fins 150 are configurable between a pre-firing stowed position and a deployed position, depicted in FIGS. 1-7. In one or more embodiments, when fired, fins 150 can deploy radially outwardly for fin stabilization of the projectile 100 during flight. In certain embodiments, fins 150 are canted. As such, in some embodiments fins 150 provide a relatively low-rate body spin on the chassis 116. For example, in certain embodiments the fins 150 provide a spin rate in the range of 10-30 rotations per second.

In various embodiments, when fired, the interaction of the strakes 160 with oncoming wind or air cause the collar 156 of the collar assembly 124 to spin-up/despin relative to the main body portion 104, the nose portion 112, and the control support portion 120. In various embodiments the spin rate of the collar 156 causes a relative rotation of the power-generation components for powering the components of the projectile 100. For example, referring to FIGS. 1-2, the strakes 160 of the collar 156 are each canted to cause despin of the collar 156 in a clock-wise direction, when viewed from the front of the projectile. FIG. 1 depicts the collar 156 in a first position and FIG. 2 depicts the collar 156 in a second position subsequent to rotation.

In one or more embodiments, when fired, the spin rate of the collar 156 spins up to about 1300 Hz±100 Hz. In various embodiments, when fired, the spin rate of the collar assembly 156 is substantially within the range of 800 Hz-2000 Hz.

In operation, the wings 164 are deployable into one or more of the positions depicted in FIGS. 1-7 to achieve various objectives for different phases of the projectile flight. For example, in certain embodiments the projectile 100 can include at least three flight phases, including a ballistic phase, a guidance phase, and a terminal guidance phase.

As described herein, the ballistic phase, guidance phase, and terminal phase, are described with reference to a projectile 100 having a high-arcing ballistic trajectory, such as a mortar, shell, or other suitable projectile. For example, when fired, the projectile 100 is launched primarily upwardly, towards a ballistic apex or maximum altitude. Subsequently, the projectile 100 begins a downwards descent towards a target. As a result, when the projectile impacts the target, the projectile is generally dropped onto the target from above. However, in various embodiments, the ballistic phase, guidance, phase, and terminal phase are also applicable to projectiles having a medium-arcing, low-arcing, or non-arcing ballistic trajectory, such as a bullet, missile, air-dropped munition, or other projectile.

In one or more embodiments, the ballistic phase is an initial phase for projectile flight that includes the period when the projectile is launched and begins initializing its guidance systems/components. For example in certain embodiments, during the ballistic phase, the projectile is fired and the collar 156 begins to spin-up or despin as the projectile 100 travels through the air. As a result of this despin, the collar assembly 124 begins generating power and the projectile 100 powers on and initializes its various electronically powered systems. For example, the projectile 100 can power on sensors such as GPS or navigation systems, communications systems, memory, processing, and other componentry.

In various embodiments, in the ballistic phase, the wings 164 are configured in the stowed position as depicted in FIGS. 1-3. As such, the wings 164 are contained within the collar 156 such that no portion of the wings 164 extends beyond the outer envelope of the collar 156. As a result, in one or more embodiments the projectile 100 may be fired from a various legacy firing platforms without the need for a sabot or specialized casing. In addition, the wings 164 are configured to minimize potential drag on the projectile 100 during the initial phase of the projectile's ballistic trajectory. As such, for the high-arcing ballistic trajectory of projectile 100, the stowed configuration of the wings 164 increases the maximum altitude of the trajectory, compared to other configurations where drag associated with the wings would slow down and correspondingly decrease the maximum altitude of the projectile 100. In addition, as a result of the increased maximum altitude, the projectile 100 is provided with a greater time period for subsequent gliding and guidance, resulting in more time for projectile course correction and in improved target tracking and accuracy. In one or more embodiments, the maximum altitude of the projectile is in the range of 2000 meters to 4000 meters.

In one or more embodiments, the guidance phase includes a period of projectile 100 flight that is subsequent to the ballistic phase, for example after the projectile 100 has been fired and after guidance systems/components in the projectile have been powered on and initialized. In various embodiments the guidance phase includes a period when the projectile 100 achieves an altitude near a max flight altitude, and includes the period as the projectile begins its general descent towards a target. In certain embodiments, the guidance phase begins when the projectile 100 reaches a specific altitude of flight. However, in some embodiments, the guidance phase could begin at a specific time mark after firing, after receiving a command signal indicating the beginning of the guidance phase, or after other event or condition.

In various embodiments, in the guidance phase, the projectile 100 becomes configured for course correction and maneuvering for gliding or descending onto a target from the ballistic apex. As a consequence, in various embodiments wings 164 will deploy outwardly from the collar 156 to generate lift for the projectile 100.

In one or more embodiments, the projectile 100 is configured to deploy the wings 164 in a manner that maximizes the lift to drag ratio for the projectile 100 during the guidance phase. As such, in certain embodiments, projectile 100 is configured to continually position the wings 164 during flight to control the wing sweep angle for each of the wings 164 for maintaining a desired lift to drag ratio during flight.

For example, in various embodiments, when the projectile 100 enters the guidance phase, the wings 164 can deploy into the second position or gliding position, as depicted in FIGS. 4-5, where the wings 164 are fully extended having a longitudinal wing axis 174 oriented generally perpendicular to the central axis 144. In certain embodiments, in the second position or gliding position, the wings 164 extend outwardly in their widest configuration. As a result, in various embodiments, the second position configures the wings 164 in a position that provides maximum lift-generating surface area.

However in addition, in certain embodiments in the second position the wings 164 also increase the profile drag force on the projectile. As such, in certain embodiments the wings 164 can be positioned or repositioned to decrease or otherwise control the wing sweep angle of wings 164. For example, in certain embodiments, the wings 164 could be repositioned to present an acute wing sweep angle with the central axis 144, such as depicted in FIGS. 6-7.

In various embodiments, by controlling the wing sweep, the projectile 100 can control the lifting force generated, and drag force on the projectile 100 at various portions of flight to maintain a desired lift to drag ratio.

In various embodiments, as a result of the maximum lift to drag ratio, the flight time is increased, resulting in more time for projectile course correction and in improved target tracking and accuracy. For example, in one or more embodiments, the wings 164 can be used to control the shape of the ballistic trajectory of the projectile to provide a shallower angle of descent.

As such, described further below, in certain embodiments an optimal or preferred lift-to-drag ratio for projectile flight can be determined prior to launch based on the location of the target for the projectile 100. For instance, in various embodiments, for targets that are located further from the launch site of the projectile, the lift-to-drag ratio could be selected to be generally higher to increase flight time for the projectile 100 and create a ballistic trajectory that reaches the distant target. Similarly, in some embodiments, for targets that are located closer to the launch site of the projectile, the lift-to-drag ratio could be selected to be generally lower to decrease flight time and create a ballistic trajectory that more quickly delivers the projectile to the target. In certain embodiments, and described further below, the lift-to-drag ratio can be calculated based on the distance from the target and/or the altitude of deployment of the projectile. In some embodiments, the calculated lift-to-drag ratio could be calculated upon identification of the target and programmed into memory/processing of the projectile to configure the projectile for launch/flight.

In one or more embodiments the terminal guidance phase include a period of projectile 100 flight subsequent to the guidance phase, for example after the projectile 100 has achieved its maximum altitude and has begun guided descent towards the target, and includes the period when the projectile 100 acquires the target and configures itself for final maneuvering or diving to achieve a final impact with the target. In certain embodiments the terminal guidance phase begins once the projectile 100 acquires a target. However in some embodiments, the terminal guidance phase could begin after the projectile reaches some altitude threshold (e.g. 100 meters), a time mark after being fired, after receiving a signal or command indicating the beginning of the terminal guidance phase, or after other condition or event.

As a consequence, in various embodiments projectile 100 configures wings 164 to sweep forwardly to decrease the wing sweep angle in the terminal guidance phase. As a result, the wings 164 provide a low drag surface that, in the high speed maneuvering of the terminal guidance phase, also provides a lift-generating surface for improved projectile maneuverability/final course corrections before impact. For example, in various embodiments and in the terminal guidance phase, the wings 164 are positioned to present an acute angle with the central axis 144, such as the third position depicted in FIGS. 6-7.

In operation, the collar assembly 124 is configured for resistive breaking, using power-generation components, to control the spin rate of the collar 156 and/or the spin rate of the remainder of the projectile 100. For example, in some embodiments resistive breaking may be used to control the despin of the collar 156 to a spin rate of approximately 0 Hz relative to the earth. In some embodiments, the resistive braking could be used to completely brake the despin of the collar 156 with respect to the chassis 116. In certain embodiments, resistive braking may be used to slow but not stop the despin of the collar assembly 124 with respect to the chassis 116. For example, resistive braking could be configured to brake the spin rate of the collar 156 to some percentage of the spin rate of a fully unbraked collar.

By controlling the spin rate, the collar assembly 124 may be used to orient the flight surfaces of the projectile 100 to provide a maneuvering force for altering trajectory, speed, or other flight characteristics of the projectile 100. For example, in one or more embodiments, by controlling the spin rate of the collar assembly 124, the projectile 100 may control the orientation of the canted angle of the wings 164 to provide a lifting force on the projectile 100 in various radial directions away from the central axis 144. In addition, in various embodiments very fast bank-to-turn maneuvering control is achieved by controlling the rotational position of the wings 164 via the collar assembly 124 during maneuvering. For example, in certain embodiments, when the wings are positioned in the third position, the projectile 100 is configured to execute very high speed maneuvers on the projectile.

For additional description of steering a projectile using aerodynamic surfaces with a fixed canted angle, see U.S. Pat. No. 6,981,672, owned by the owner of the instant application and is incorporated by reference in its entirety.

As a consequence of the ability to deploy and orient the wings 164, and/or other flight surfaces of the projectile, the collar assembly 124 extends the effective range of the projectile 100 by using the collar 156 to compensate for various environmental/in-flight factors that influence the projectile off its originally aimed path and to otherwise steer the projectile to its target. In addition, in various embodiments, the collar assembly 124 extends the effective range of the projectile by providing a lifting force on the projectile 100 allowing the projectile to at least partially glide or slow its descent. In some embodiments, the collar assembly 124 can dramatically extend the effective range of the projectile compared to that of a typical projectile. In addition, in various embodiments the ability to control the in-flight trajectory of the projectile 100 improves projectile accuracy by using the collar assembly 124 to compensate for moving targets, to compensate for aiming errors, or for other scenarios that would normally result in a projectile miss.

In addition, in various embodiments, by braking or slowing the spin rate of the collar assembly 124, the spin rate of the remainder of the projectile 100 can be slowed. For example, in various embodiments, engaging a resistive braking force between the control support portion 120 and the collar assembly 124 results in rolling resistance on the rotational motion of the tail portion 108 that slows the spin rate of the chassis 116 that includes the tail portion 108, main body portion 104, and the nose portion 112. In addition, in various embodiments, engaging a resistive braking force between the control support portion 120 and the collar assembly 124 causes the interaction of the aerodynamic control surfaces with oncoming wind or air cause the collar assembly 124 to counteract the rotation of the chassis 116, as the orientation of the aerodynamic control surfaces that would normally despin the collar generate a counter-rotational force with the oncoming air that slows the spin rate of the projectile 100.

While FIGS. 1-7 and other figured described herein depict a projectile 100 having a forwardly positioned collar assembly 124 and collar 156, positioned intermediate the body portion 104 and nose portion, in various embodiments the projectile 100 can instead include a despun control portion positioned more rearwardly, such as at the tail portion 108, or even more forwardly, such as in the nose portion 112. For example, discussed further below with reference to FIGS. 8-11, the despun control portion could be positioned between the main body portion and the tail portion.

In addition, while the despun control portion may, in some embodiments, be designed as a collar, in certain embodiments the despun control portion may utilize other types of designs suitable for directional projectile control.

In various embodiments, the projectile is non-boosted or non-propelled and is fired from a barrel of a gun, mortar, launch tube, or other suitable projectile firing platform. As used herein, the terms "non-boosted", or "non-propelled", means that no active propulsion means such as powered propellers, turbines, jet engines, rocket engines, or propellants are associated with the projectile after it leaves the barrel of the projectile firing platform. Rather, as a non-limiting example, a non-boosted or non-propelled projectile includes projectiles that are fired using propellant included in the barrel or in a casing or cartridge of which the projectile is part, or even included in the projectile 100 itself. For example, referring to FIG. 7, the cross-sectional view shows that the tail portion 108 includes a propellant 188 and primer 190 located within an interior space of the tail portion 108 defined by an outer sidewall. In various embodiments the projectile 100 is configured to be launched by dropping the projectile 100 tail first into a mortar tube having a firing pin such that the firing pin activates the primer and propellant. As a result of striking the primer 190 the propellant 188 reacts to propel the projectile via expanding gas/pressure within the mortar tube.

However, in certain embodiments the projectile 100 may be boosted or self-propelled, where the projectile includes active propulsion means such as powered propellers, turbines, jet engines, rocket engines, or propellants are associated with the projectile after it leaves the muzzle of the gun.

FIGS. 8-11, depict side views and cross sectional views of a guided projectile 200 according to one or more embodiments of the disclosure. In various embodiments projectile 200 is a medium or high caliber spin-stabilized projectile for firing from a rifled barrel or gun. For example, in certain embodiments, projectile 200 could be a 57 mm (millimeter) medium caliber round, a 90 mm large caliber round, or other suitable sized round. In certain embodiments, projectile 200 could be a small caliber round. As used herein, a medium caliber projectiles includes rounds greater than 50 caliber up to about 75 mm, a large caliber projectile includes rounds greater than 75 mm, and small caliber projectiles include rounds less than 50 caliber.

In various embodiments, projectile 200 shares similar elements with projectile 100, depicted above with reference to FIGS. 1-7, as such, similar elements are referred to using the same reference numerals. For instance, in one or more embodiments, the projectile 200 includes a main body portion 104, a tail portion 108, and a nose portion 112. A chassis 116 extends from the nose portion 112, defines the main body portion 104, and extends to the tail portion 108. In addition, in various embodiments the chassis 116 includes a control support portion 120 for supporting a collar assembly 124. In one or more embodiments, the nose portion 112 and/or main body portion 104 provides a structure for containing and/or supporting various elements of the projectile 200 including payload and/or operational components. For example, in various embodiments the main body portion 104 includes payload 117.

In one or more embodiments the chassis 116 defines the control support portion 120. In various embodiments, the control support portion 120 is a structure that is unitary or integral with the chassis 116 for supporting various components of the projectile 200. In one or more embodiments, the control support portion 120 includes an axially projecting central stub portion 122 for supporting the collar assembly 124 and other elements of the projectile 200.

Figure 9:
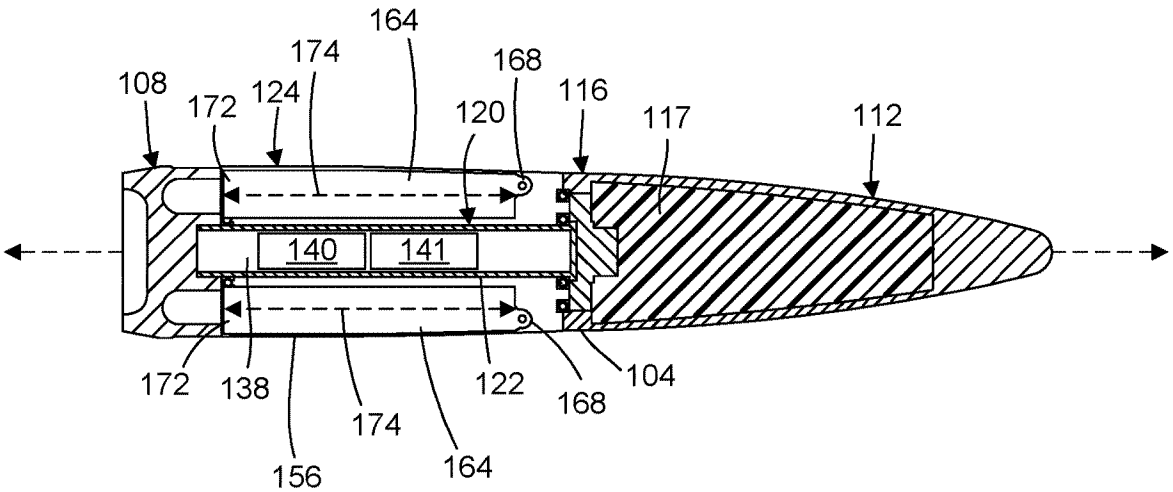
Figure 10:
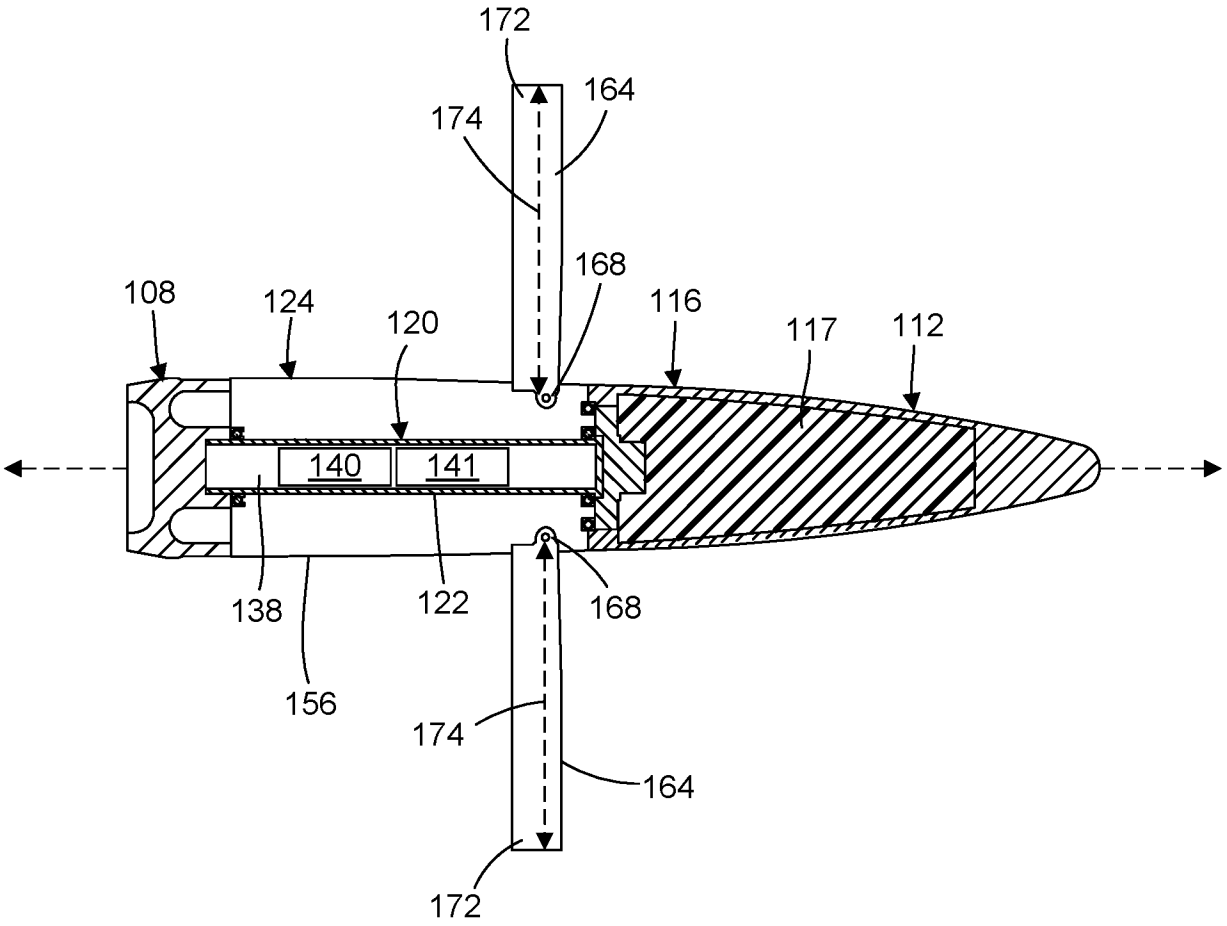
Figure 11:
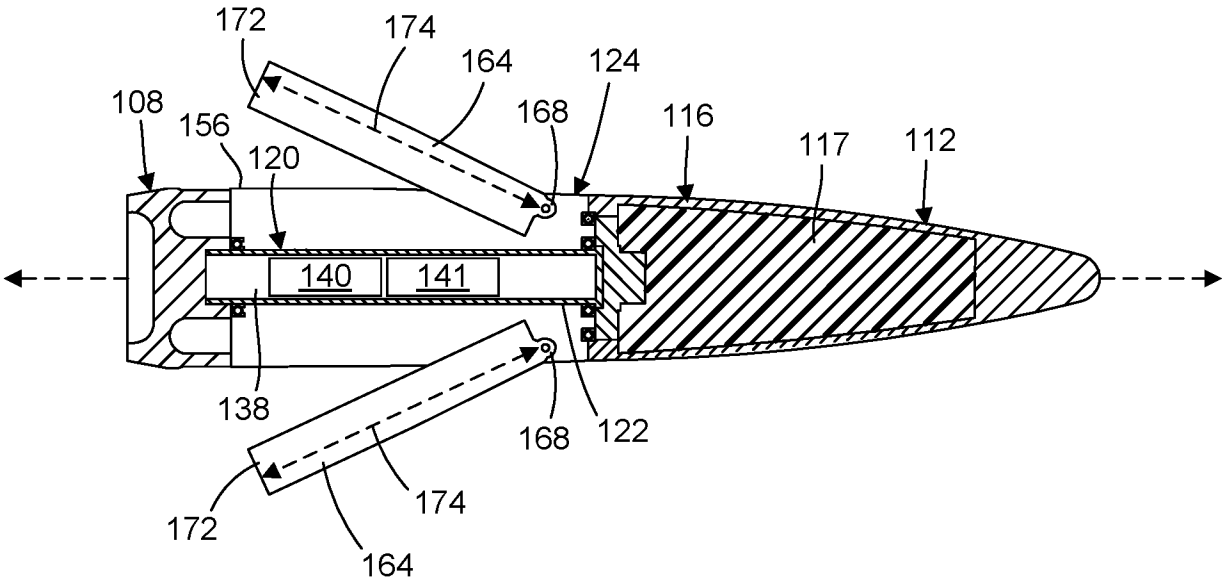

Depicted in FIGS. 9-11, the central stub portion 122, is positioned intermediate the main body portion 104 and the tail portion 108 of the projectile 200, extending axially from the nose portion 112 to the main body portion 104. As described above, in various embodiments the central stub portion 122 is a tubular, or otherwise hollow structure with an outer wall that defines an interior space 138 for supporting various elements of the projectile 200. For example, in one or more embodiments the central stub portion 122 supports components 140 configured for internal power generation and/or rotational braking of the collar. In certain embodiments, the central stub portion 122 includes components 141 configured for communication, sensing, processing, or for other functions of the projectile 200. In various embodiments, additional or alternative components of the projectile 200 may be located within the interior space 138 defined by the control support portion 120.

In one or more embodiments, the collar assembly 124 includes a plurality of variable sweep wings 164. In various embodiments each of the plurality of wings 164 are an elongated wing-shaped structure having a body extending between a first end portion 168 and a second end portion 172 along a longitudinal wing axis 174. In various embodiments, the first end portion 168 of each of the wings 164 are pivotably or rotationally mounted to an interior of the collar 156 and are operably coupled with a wing actuator configured to rotate the wings 164 about the first end portion 168 between one or more of a variety of rotational positions, including a first, second and third rotational position as described above and depicted in FIGS. 9-11. In various embodiments the collar 156 includes a plurality of slot or wing-shaped apertures 180 defined in the exterior surface 158 of the collar 156 and aligned with each of the wings 164 to allow outward deployment or rotation of each of the wings 164. In various embodiments the first end portion 168 of the wings 164 is positioned at or rearward of a center of mass of the projectile 200. As such, wings 164 provide a lift force that is positioned at or near the center of mass of the projectile 200 for more efficient maneuvering in flight.

In one or more embodiments, each of the wings 164 are canted at a fixed angle relative to the central axis 144. For example, referring to FIG. 5B, a front view of the projectile 100 is depicted showing canted wings 164 having a front edge or leading edge raised higher than a tailing edge to provide an angled or canted surface for generating a lifting force or maneuvering torque on the projectile 100, described further below.

In certain embodiments this rotation of the wings 164 is reversed relative to the configuration of projectile 100, where the wing actuator is configured to deploy the wings 164 by rotating the second end portion 172 of the wings 164 outwardly from the exterior sidewall 158 and forwardly towards the nose portion 112. In addition, while the first end portion 168 is depicted as rotatably mounted in the collar 156, in certain embodiments the second end portion 172 or other portion of the wings 164 could be rotatably mounted in the collar 156.

In addition, in various embodiments, the collar assembly 124, the tail portion 108, and the control support portion 120 are configured as a guidance assembly that is removably attached to the body portion 104 to form a modular system for guidance control. As such, in various embodiments, the collar assembly 124, tail portion 108, and control support portion 120 could be retrofitted onto legacy hardware or spin-stabilized projectiles without the need to re-design or re-configure existing arsenals.

In some embodiments, the main body portion 104 can include a plurality of lift strakes. In one or more embodiments, lift strakes are aerodynamic ridges or fins extending from the main body portion 104 of the spin-stabilized projectile 100. Lift strakes are discussed in further detail in U.S. patent application Ser. No. 15/290,768 entitled "Steerable Projectile with Lift Stakes", which is incorporated by reference herein in its entirety.

In some embodiments, the projectile 200 can include a crimped portion and a band for coupling with a casing of a cartridge. The crimped portion may include various indentations in the chassis 116 that allow for a secure connection between the chassis 116 and the casing of a cartridge.

In certain embodiments, the band is constructed of material such as nylon, plastic, copper, or other suitable material and allows for a secure sealing engagement with a rifled barrel of a gun for firing. Crimped portions of a main body portion of a projectile are discussed in further detail in U.S. patent application Ser. No. 15/290,755 entitled "Extended Range Medium Caliber Steerable Projectile", which is incorporated by reference herein in its entirety.

Depicted in FIGS. 8-11, projectile 200 is spin-stabilized rather than fin-stabilized. As such, in one or more embodiments, in operation the projectile 200 may be fired from a projectile firing platform at various muzzle velocities and at various muzzle spin rates based on the propellant used and the design (e.g. rifling) of the projectile delivery system. For example, in one or more embodiments, the projectile 200 is fired having an initial spin rate of 1300 Hz±100 Hz. In various embodiments, when fired, the initial spin rate of the projectile 200 is substantially within the range of 800 Hz-2000 Hz. In one or more embodiments, when fired, the spin rate of the collar 156 is about 1300 Hz±100 Hz. In various embodiments, when fired, the spin rate of the collar 156 is substantially within the range of 800 Hz-2000 Hz.

As described above, in various embodiments, when fired, the interaction of the strakes 160 with oncoming wind or air cause the collar 156 of the collar assembly 124 to despin relative to the main body portion 104, the nose portion 112, and the control support portion 120. In various embodiments the spin rate of the collar 156 causes a relative rotation of the power-generation components for powering the components of the projectile 200.

As described above, the wings 164 are deployable into one or more of the positions depicted in FIGS. 8-11 to achieve various objectives for different phases of the projectile flight. For example, the projectile 200 could be in at least three flight phases, including a ballistic phase, a guidance phase, and a terminal guidance phase, substantially similar to the flight phases as described above.

Figure 8:
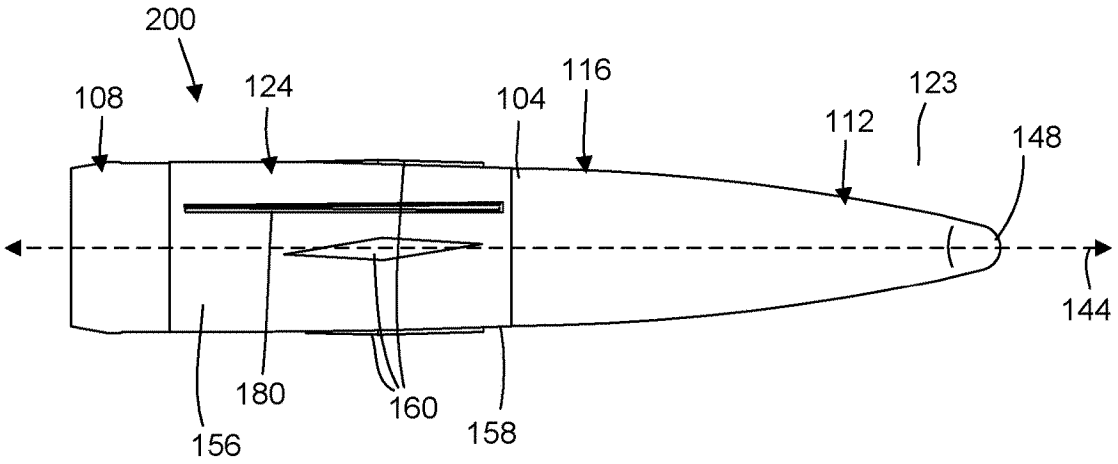
FIGS. 8-11 depict side views and cross sectional views of a guided projectile according to one or more embodiments of the disclosure.

As such, in various embodiments, in the ballistic phase, the wings 164 are configured in the stowed position as depicted in FIGS. 8-9. As such, the wings 164 are contained within the collar 156 such that no portion of the wings 164 extends beyond the outer envelope of the collar 156. As a result, in one or more embodiments the projectile 200 may be fired from a various legacy firing platforms without the need for a sabot or specialized casing. In addition, the wings 164 are configured to minimize potential drag on the projectile 200 during the initial phase of the projectile's ballistic trajectory. As such, for a ballistic trajectory of projectile 200, the stowed configuration of the wings 164 increases the maximum altitude of the trajectory, compared to other configurations where drag associated with the wings would slow down and correspondingly decrease the maximum altitude of the projectile 200. In addition, as a result of the increased maximum altitude, the projectile 200 is provided with a greater time period for subsequent gliding and guidance, resulting in more time for projectile course correction and in improved target tracking and accuracy. In one or more embodiments, the maximum altitude of the projectile is in the range of 2000 meters to 4000 meters.

In various embodiments, in the guidance phase, the projectile 200 becomes configured for course correction and maneuvering for gliding or descending onto a target from the ballistic apex. As a consequence, in various embodiments wings 164 will deploy outwardly from the collar 156 to generate lift for the projectile 200. In certain embodiments the wings 164 can be positioned or repositioned to decrease or otherwise control the wing sweep angle of wings 164. For example, in certain embodiments, the wings 164 could be repositioned to present an acute angle with the central axis. As described, in various embodiments, by controlling the wing sweep, the projectile 200 can control the lifting force generated, and drag force on the projectile 200 at various portions of flight to maintain a desired lift to drag ratio.

In various embodiments, by maximizing the projectile's lift to drag ratio, the flight time is increased, resulting in more time for projectile course correction and in improved target tracking and accuracy. For example, in one or more embodiments, the wings 164 can be used to control the shape of the ballistic trajectory of the projectile to provide a shallower angle of descent and/or change or correct the ballistic trajectory in flight. In addition, in such embodiments, the increased flight time provides for an increased range at which the projectile can effectively engage with targets. For instance, in various embodiments the wings 164 can be used to control the direction and steering of the projectile near or at the end of the projectile's maximum theoretical range to allow for accurate engagement where normally environmental factors, decreased velocity, and other factors would normally make target engagement unreliable.

In various embodiments projectile 200 configures wings 164 to sweep forwardly to decrease the wing sweep angle in the terminal guidance phase. As a result, the wings 164 provide a low drag surface that, in the high speed maneuvering of the terminal guidance phase, provides a lift-generating surface for improved projectile maneuverability/final course corrections before impact.

For example, in various embodiments and in the terminal guidance phase, the wings 164 are positioned to present an acute angle with the central axis 144, such as the position depicted in FIG. 11.

In operation, the collar assembly 124 is configured for resistive breaking, using power-generation components, to control the spin rate of the collar 156 and/or the spin rate of the remainder of the projectile 200. For example, in some embodiments resistive breaking may be used to control the despin of the collar 156 to a spin rate of approximately 0 Hz relative to the earth.

In some embodiments, the resistive braking could be used to completely brake the despin of the collar 156 with respect to the chassis 116. In certain embodiments, resistive braking may be used to slow but not stop the despin of the collar assembly 124 with respect to the chassis 116. For example, resistive braking could be configured to brake the spin rate of the collar 156 to some percentage of the spin rate of a fully unbraked collar.

By controlling the spin rate, the collar assembly 124 may be used to orient the flight surfaces of the projectile 200 to provide a maneuvering force for altering trajectory, speed, or other flight characteristics of the projectile 200. For example, in one or more embodiments, by controlling the spin rate of the collar assembly 124, the projectile 200 may control the orientation of the canted angle of the wings 164 to provide a lifting force on the projectile 200 in various radial directions away from the central axis 144. In addition, in various embodiments very fast bank-to-turn maneuvering control is achieved by controlling the rotational position of the wings 164 during maneuvering. For example, in certain embodiments, when the wings are positioned in the third position, the projectile 200 is configured to execute very high speed maneuvers on the projectile.

For additional description of steering a projectile using aerodynamic surfaces with a fixed canted angle, see U.S. Pat. No. 6,981,672, owned by the owner of the instant application and is incorporated by reference in its entirety.

As a consequence of the ability to deploy and orient the wings 164, and/or other flight surfaces of the projectile, the collar assembly 124 extends the effective range of the projectile 200 by using the collar 156 to compensate for various environmental/in-flight factors that influence the projectile off its originally aimed path and to otherwise steer the projectile to its target. In addition, in various embodiments, the collar assembly 124 extends the effective range of the projectile by providing a lifting force on the projectile 200 allowing the projectile to at least partially glide or slow its descent. In some embodiments, the collar assembly 124 can dramatically extend the effective range of the projectile compared to that of a typical projectile. For example, in various embodiments projectile 200 using wings 164 can achieve a downrange capability of between and including 50 kilometers to 100 km. In certain embodiments the projectile 200 using wings 164 can achieve a downrange capability of 70 km.

In addition, in various embodiments the ability to control the in-flight trajectory of the projectile 200 improves projectile accuracy by using the collar assembly 124 to compensate for moving targets, to compensate for aiming errors, or for other scenarios that would normally result in a projectile miss. For example, in one or more embodiments the maneuvering capabilities of the projectile 200 results in a ±40 km cross-range capability for the ballistic trajectory of the projectile 200.

In addition, in various embodiments, by braking or slowing the spin rate of the collar assembly 124, the spin rate of the remainder of the projectile 200 can be slowed. For example, in various embodiments, engaging a resistive braking force between the control support portion 120 and the collar assembly 124 results in rolling resistance on the rotational motion of the tail portion 108 that slows the spin rate of the chassis 116 that includes the tail portion 108, main body portion 104, and the nose portion 112. In addition, in various embodiments, engaging a resistive braking force between the control support portion 120 and the collar assembly 124 causes the interaction of the aerodynamic control surfaces with oncoming wind or air cause the collar assembly 124 to counteract the rotation of the chassis 116, as the orientation of the aerodynamic control surfaces that would normally despin the collar generate a counter-rotational force with the oncoming air that slows the spin rate of the projectile 200.

Figure 12:
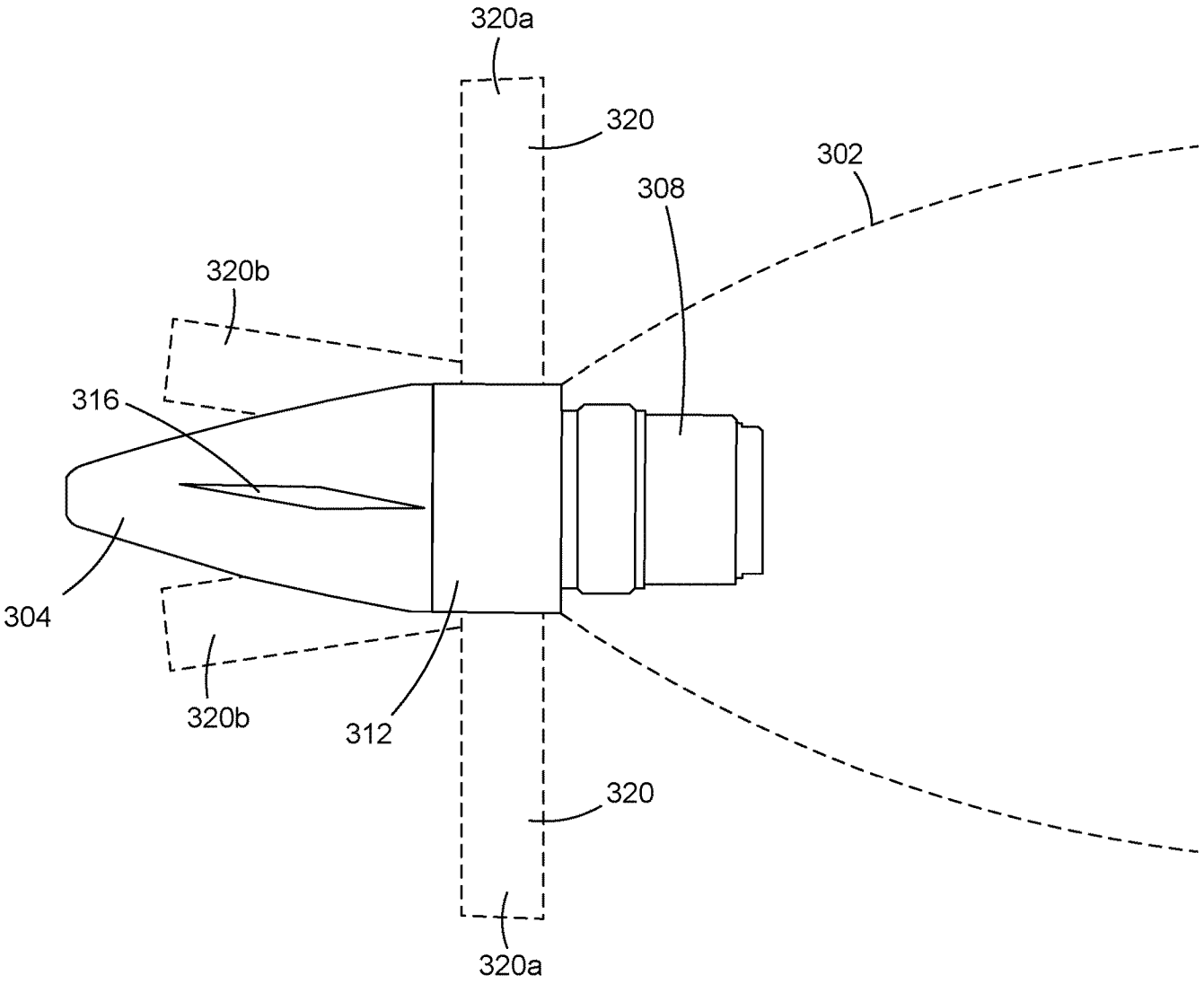
FIG. 12 depicts a system for projectile guidance, according to one or more embodiments of the disclosure.

Referring to FIG. 12, a system 300 for guiding a projectile is depicted according to one or more embodiments. In one or more embodiments, the system is a modular system removably attachable to a chassis of a projectile 302 in order to configure the projectile for guided flight according to one or more of the embodiments described herein.

In various embodiments the system 300 includes a projectile nose portion 304 and a control support portion 308 extending axially from the nose portion 304. In certain embodiments the system 300 includes a collar assembly 312 having a collar pivotally mounted to the control support portion 308, the collar having a circumferentially and axially extending exterior sidewall with a plurality of fixed aerodynamic surfaces 316 thereon for spinning the collar and the collar having a plurality of variable sweep wings 320 for directional control of the projectile. In various embodiments the plurality of variable sweep wings 320 each have a first end portion pivotally mounted to an interior of the collar and coupled to a wing actuator configured to rotate the wings between and including a first position 320*a*, where the wings are oriented having a lengthwise wing axis generally parallel to the central axis of the projectile to a second position 320*b*, where the second end portion of the wings are rotated outwardly from the sidewall of the collar and where the lengthwise wing axis of the plurality of wings are oriented generally perpendicular to the central axis of the projectile.

In one or more embodiments the system 300 is configured for insertion in the nose cavity of an artillery shell, mortar, or other suitable projectile. For example in certain embodiments, the control support portion 308 includes a body portion that inserts into the nose cavity to be non rotatable with respect to the artillery shell when fired. Further, in certain embodiments, the collar assembly 312 includes a rotatable portion on the body portion that is rotatable with respect to the body portion, the rotatable portion having fixed aero surfaces for despinning the rotatable portion after the artillery shell is fired, the rotatable portion having a pair of extendable wings 320 movable outwardly to a glide position and movable forwardly to a high maneuverability position as the artillery shell is approaching a target.

In various embodiments, the system can include a processor and a non-transitory computer readable storage medium including various instructions executable by the processor to cause the processor to operate the system according to the various described embodiments herein.

Referring to FIGS. 13, 14A, 14B, and 14C a ballistic trajectory 800 for a guided projectile with a despun wing control system, a method 900 for maneuvering a projectile with a despun wing control system is depicted, and a method 930 for configuring a projectile a guided projectile with a despun wing control system prior to launch is depicted, according to one or more embodiments.

Figure 13:
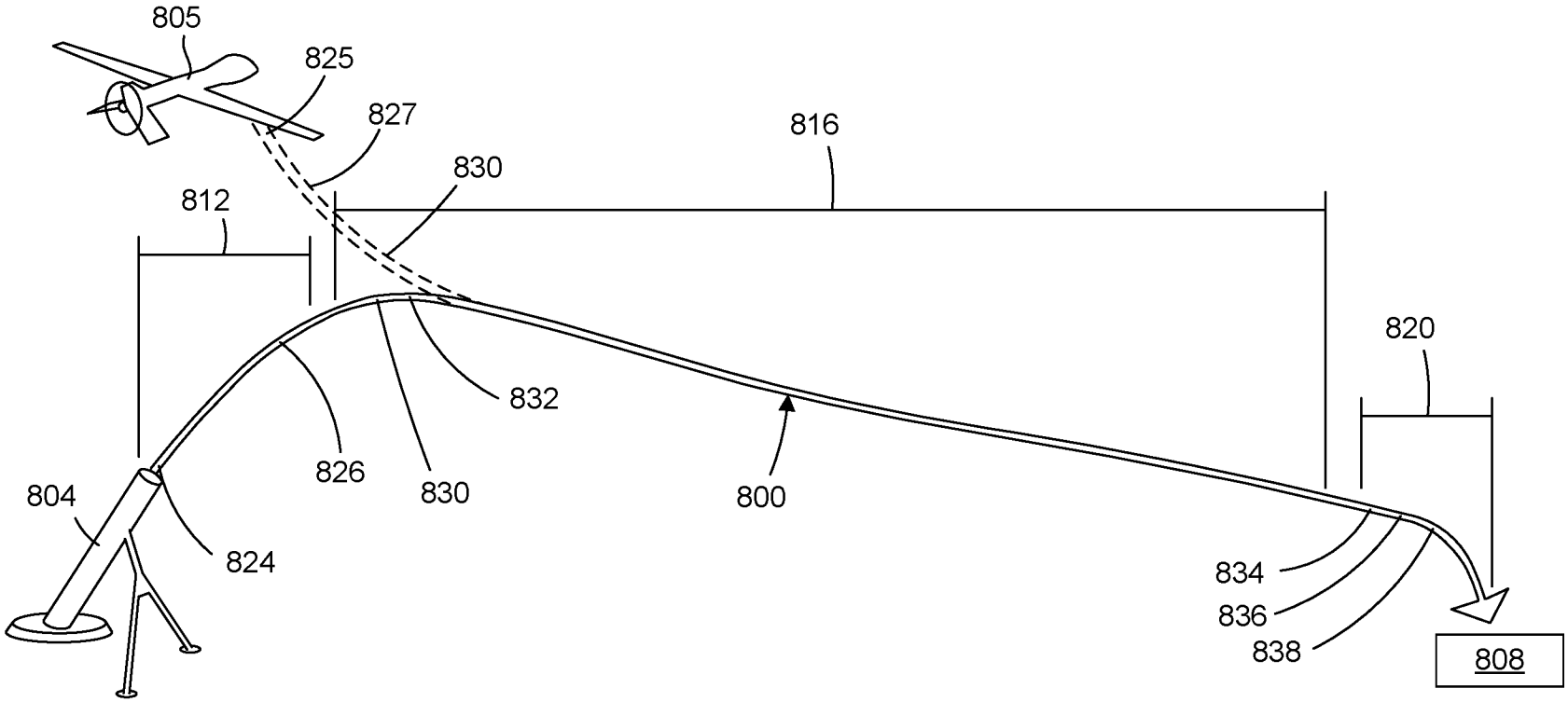
FIG. 13 depicts a ballistic trajectory for a guided projectile with a despun wing control system and FIG. 14A depicts a method for maneuvering a projectile with a despun wing control system are depicted, according to one or more embodiments of the disclosure.

Referring to FIG. 13, the ballistic trajectory 800 depicts a high level view of a flight path of a projectile, such as projectile 100 depicted in FIGS. 1-7 and/or projectile 200 depicted in FIGS. 8-11, from being fired or launched from a projectile firing platform 804 to impact with a target 808.

In one or more embodiments, the ballistic trajectory 800 is broken into or classified according to three phases of flight. As described above, in one or more embodiments these phases include, but are not limited to, a ballistic phase 812, a guidance phase 816, and a terminal guidance phase 820.

In one or more embodiments, the ballistic phase 812 is the initial phase for projectile flight that includes projectile firing and initializing guidance systems/components. For example, FIG. 13 includes denoted portions of the ballistic trajectory 824 and 826. In one or more embodiments, portion 824 corresponds to firing or launching of the projectile. In addition, in various embodiments portion 824 corresponds to initial spin-up of the projectile and despin/spin-up of the collar and variable sweep wings, as described above with reference to FIGS. 1-11. Further, in various embodiments, portion 824 corresponds to the projectile beginning power generation via internally mounted power generation components as described above.

In one or more embodiments, portion 826 corresponds to powering on internal componentry of the projectile. As such, in various embodiments portion 826 corresponds to powering on of GPS sensors, navigation systems, collar braking systems, processing, memory and other electronic components of the projectile.

Figure 14A:
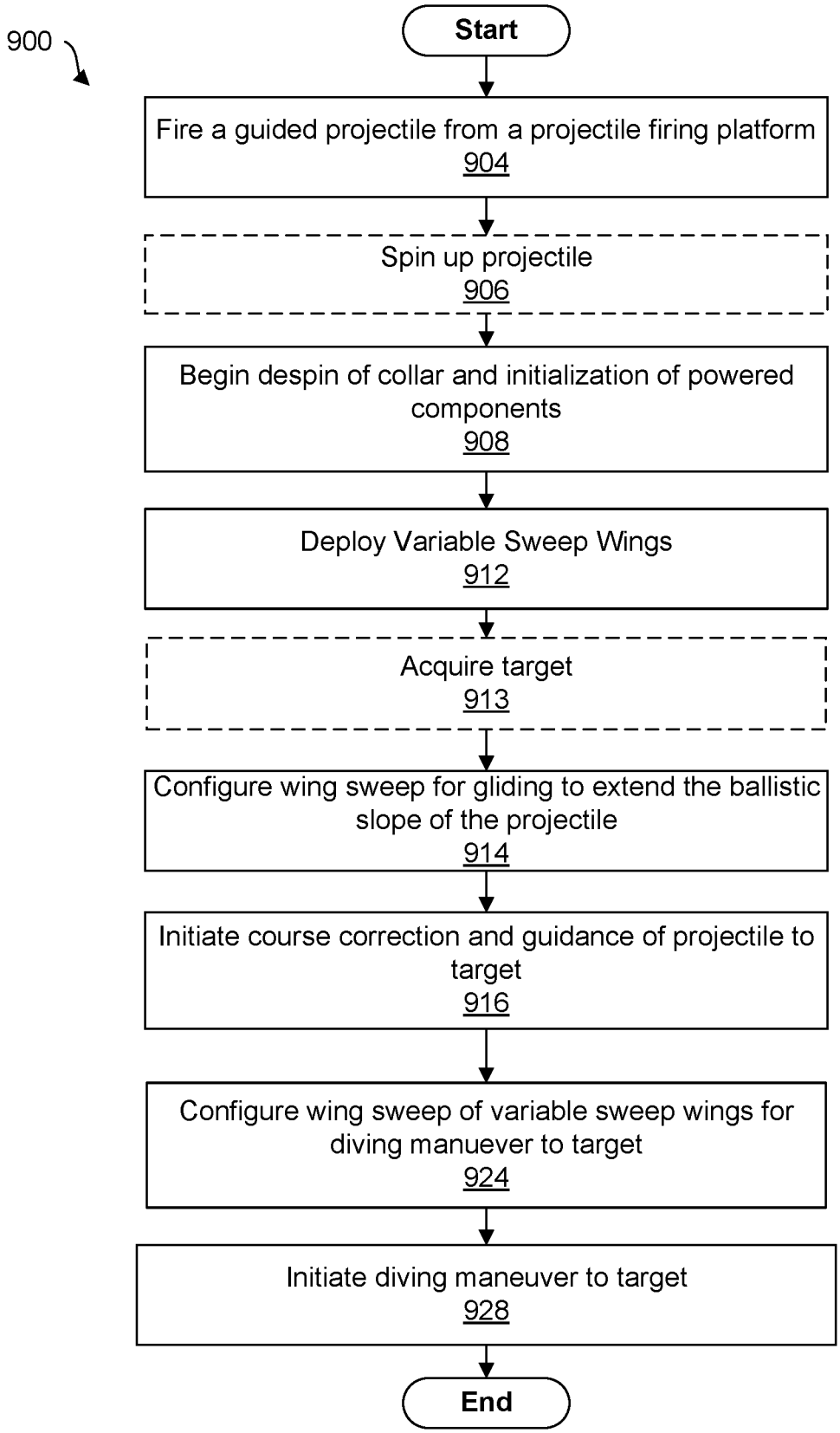

In addition, referring to FIG. 14A, in one or more embodiments the ballistic phase 812 corresponds to operations 904, 906, and 908 in method 900, and operation 904 in method 930, where the methods include firing a projectile from a firing platform, spinning up the projectile, and the projectile includes despin of a flight control collar for power generation and initialization or powering on of electronically powered components.

As described above, in various embodiments the projectile firing platform can include various types of firing platforms. For example, FIG. 13 depicts a mortar 804. However, in various embodiments the firing platform could include rifled guns, such as the M777, a Navy 5-inch gun, or other rifled gun. Similarly, in various embodiments the firing platform could include a launch tube or other firing platform that is included as part of a vehicle. For instance, FIG. 13 depicts an aerial vehicle 805 that is configured to launch or deploy a guided projectile using a launch tube, for aerial deployment of the guided projectile. While the aerial vehicle 805 depicted in FIG. 13 is depicted as a done, in various embodiments the aerial vehicle 805 can include piloted air-vehicles such as helicopters, planes, and the like.

In such embodiments, FIG. 13 includes denoted portions of the ballistic trajectory 825 and 827. In one or more embodiments, portion 825 corresponds to firing or launching of the projectile. In addition, in various embodiments portion 825 corresponds to initial spin-up of the projectile and despin/spin-up of the collar and variable sweep wings, as described above with reference to FIGS. 1-11. Further, in various embodiments, portion 825 corresponds to the projectile beginning power generation via internally mounted power generation components as described above. In one or more embodiments, portion 827 corresponds to powering on internal componentry of the projectile. As such, in various embodiments portion 827 corresponds to powering on of GPS sensors, navigation systems, collar braking systems, processing, memory and other electronic components of the projectile.

In various embodiments, as described above in the ballistic phase 812 the projectile includes wings configured in the stowed position as depicted in FIGS. 1-3 and FIGS. 8-9. As such, the wings are contained within the collar of the projectile such that no portion extends beyond an outer envelope of the collar. As a result, in one or more embodiments the projectile may be fired from a various legacy firing platforms without the need for a sabot or specialized casing. In addition, the wings are configured to minimize potential drag on the projectile during the initial phase of the projectile's ballistic trajectory. As a result, the projectile will increase the maximum altitude of the projectile trajectory 800 when the projectile is fired from ground in a high-arcing trajectory.

In one or more embodiments, the guidance phase 816 includes a period of projectile flight that is subsequent to the ballistic phase 812, for example after the projectile has been fired and after guidance systems/components in the projectile have been powered on and initialized. As described above, in the guidance phase 816, the projectile generally configures for course correction and maneuvering to extend the ballistic trajectory and descend onto the target 808 from an apex of the ballistic trajectory 800.

For example, in one or more embodiments in the guidance phase the deployed configuration of the wings can extend the range of the projectile to achieve a 50 kilometer (km) to 100 km downrange capability for the projectile. In some embodiments, the deployed configuration of the wings, along with the maneuvering capabilities brought on by the wings allow for a ±40 km cross-range capability. In such embodiments, and described further below, the downrange/cross-range capability is also configurable before and subsequent to launch via configuration of internal wings to achieve a desired lift-to-drag ratio for projectile flight.

FIG. 13 includes denoted portions of the ballistic trajectory 830 and 832. In one or more embodiments, portion 830 corresponds to deploying wings of the projectile outwardly to generate lift for maneuvering the projectile. For example, in various embodiments, when the projectile enters the guidance phase 816, the wings can deploy into the second position or gliding position, as depicted in FIGS. 4-5 and 10.

In various embodiments, portion 832 corresponds to the apex or maximum altitude of a high-arcing ballistic trajectory 800. In one or more embodiments, the maximum altitude of the projectile in a high-arcing trajectory is in the range of 2000 meters to 4000 meters. However, in other embodiments, the maximum altitude could be greater or lower depending on the arcing shape of the ballistic trajectory, on the projectile used, propellant used, or on other factors.

In addition, in one or more embodiments the guidance phase 816 corresponds to operations 912, 914, and 916 in method 900, where the method 900 includes deploying the variable sweep wings of the projectile, configuring the wing sweep for gliding to extend the ballistic slope of the projectile, and initiating course correction and guidance of the projectile to the target. In certain embodiments, the guidance phase 816 additionally corresponds to operation 913 where the target for the projectile is acquired. However, in certain embodiments, such as depicted in method 930, the target could be acquired prior to launch. In various embodiments the target could be acquired by a sensory array in projectile, a sensor array located on ground or in the air, or by other means, such as by receiving set of GPS coordinates that is manually or automatically generated and designate a target location for projectile impact.

In one or more embodiments the terminal guidance phase 820 include a period of projectile flight subsequent to the guidance phase 816. As described above, the terminal guidance phase 820 includes the period when the projectile acquires the target 808 and configures itself for final maneuvering or diving to achieve a final impact with the target. In some embodiments the terminal guidance phase 816 begins with the acquisition of the target 808. However, in other embodiments the terminal guidance phase is initiated when the projectile reaches a specific altitude, angle of attack, hits a flight time threshold, or with another event. For example, in certain embodiments the terminal guidance phase 816 begins when the projectile reaches an altitude in the range of 50-200 meters.

For example, FIG. 13 includes denoted portions of the ballistic trajectory 834, 836, 838. In one or more embodiments, portion 834 corresponds to acquiring the target 808. In various embodiments, the target is acquired using various sensors or other devices in the projectile such as heat or infrared sensors, optical sensors, magnetic sensors, or other suitable devices. In certain embodiments, portion 836 corresponds to configuring the wings of the projectile for a diving maneuver. As described above, in various embodiments projectile configures wings to sweep forwardly to decrease the wing sweep angle in the terminal guidance phase. As a result, the wings 164 provide a low drag surface that, in the high speed maneuvering of the terminal guidance phase, provides a lift-generating surface for improved projectile maneuverability/final course corrections before impact. For example, in the terminal guidance phase, the wings 164 can be positioned to present an acute angle, such as depicted in FIGS. 6-7 and 11.

In various embodiments, portion 838 corresponds to initiating the diving maneuver to impact the target 808.

Figure 14B:
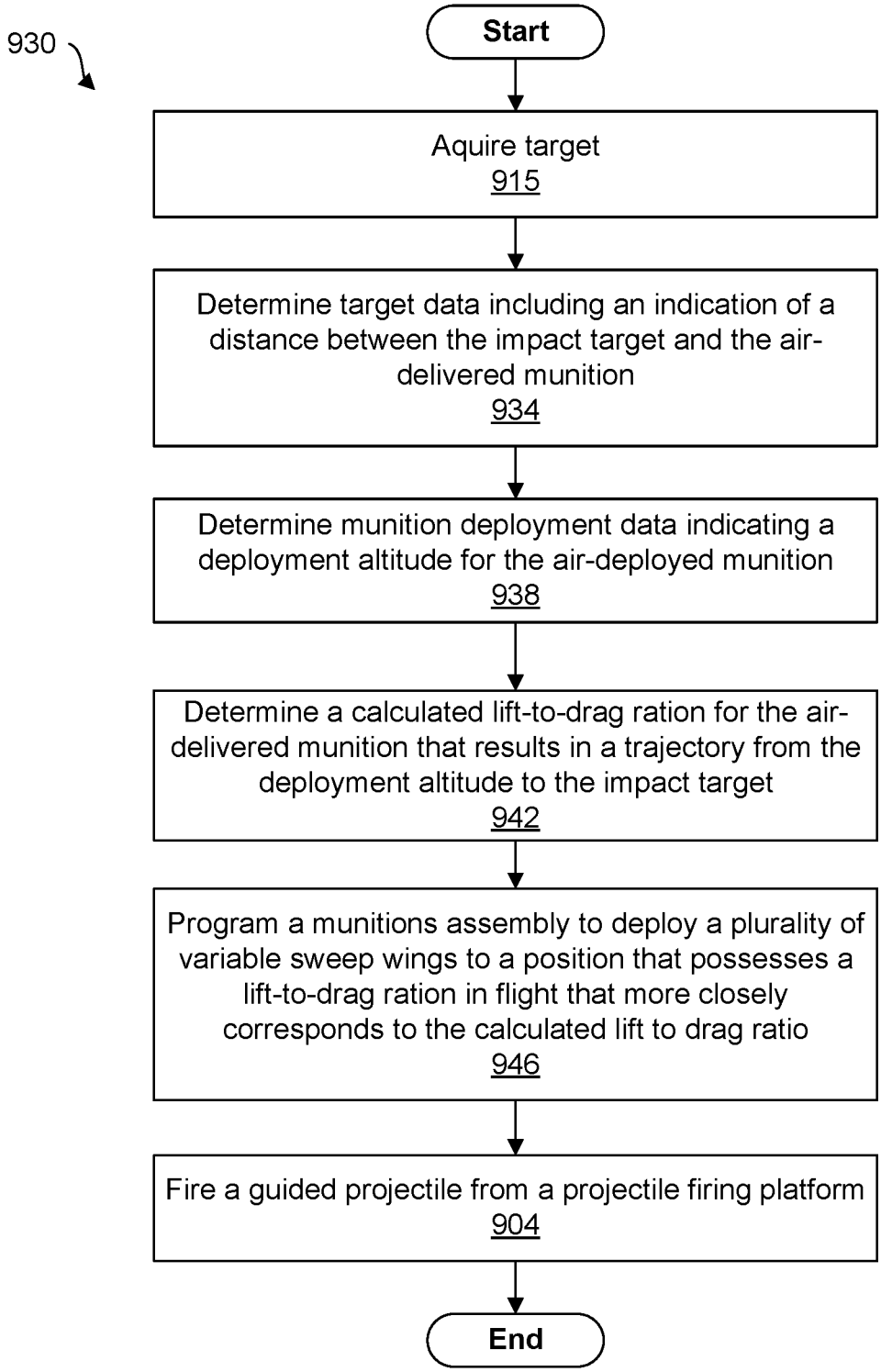
FIG. 14B depicts a method for configuring a projectile with a despun wing control system prior to launch, according to one or more embodiments of the disclosure.

In addition, in one or more embodiments the terminal guidance phase 820 corresponds to operations 924 and 928 in method 900, where the method 900 includes configuring the wings sweep of the variable sweep wings for diving maneuver to target and initiating the diving maneuver Referring to FIG. 14B, in various embodiments the projectile can be programmed prior to launch to deploy with a selected wing sweep that corresponds to a target location.

As such, in various embodiments, the method 930 includes, at operations 915 and 934, acquiring a target and determining target data including an indication of a distance between the target and the air-delivered munition. In one or more embodiments, the method 930 includes, at operation 938, determining munition deployment data including an indication of a deployment altitude for the air-delivered munition.

In various embodiments the method 930 includes, at operation 942, determining, using the deployment altitude and the distance between the impact target and the munitions assembly, a calculated lift to drag ratio for the air-delivered munition that results in a trajectory from the deployment altitude to the impact target. As described above, in various embodiments, for targets that are located further from the launch site of the projectile, the lift-to-drag ratio could be selected to be generally higher to increase flight time for the projectile 100 and create a ballistic trajectory that reaches the distant target. Similarly, in some embodiments, for targets that are located closer to the launch site of the projectile, the lift-to-drag ratio could be selected to be generally lower to decrease flight time and create a ballistic trajectory that more quickly delivers the projectile to the target.

In one or more embodiments, the method 930 includes at operation 946, programming the munitions assembly to deploy the plurality of variable sweep wings to a wing sweep angle such that, when the plurality of variable sweep wings are deployed, the air-deployed munition would possess a lift-to-drag ratio in flight that more closely corresponds to the calculated lift to drag ratio. For example, as described above, in certain embodiments the projectile could be programmed to take one or more of a plurality of positions including a first position, where the wings are oriented having a lengthwise wing axis generally parallel to the central axis of the projectile and no portion of the wings extends outwardly beyond an outer envelope of the collar, a second position, where the second end portion of the wings are rotated outwardly from the sidewall of the collar and where the lengthwise wing axis of the plurality of wings are oriented generally perpendicular to the central axis of the projectile, or a third position, where the wings are oriented having the lengthwise wing axis at an angle with respect to the central axis such that the wings have an acute wing sweep angle. As described above, each of the plurality of positions will configure the munitions assembly with a different wing sweep angle and a corresponding lift-to-drag ratio to affect the ballistic trajectory of the projectile.

In various embodiment, the method 930 includes at operation 904, firing a projectile from a firing platform as described above.

Figure 14C:
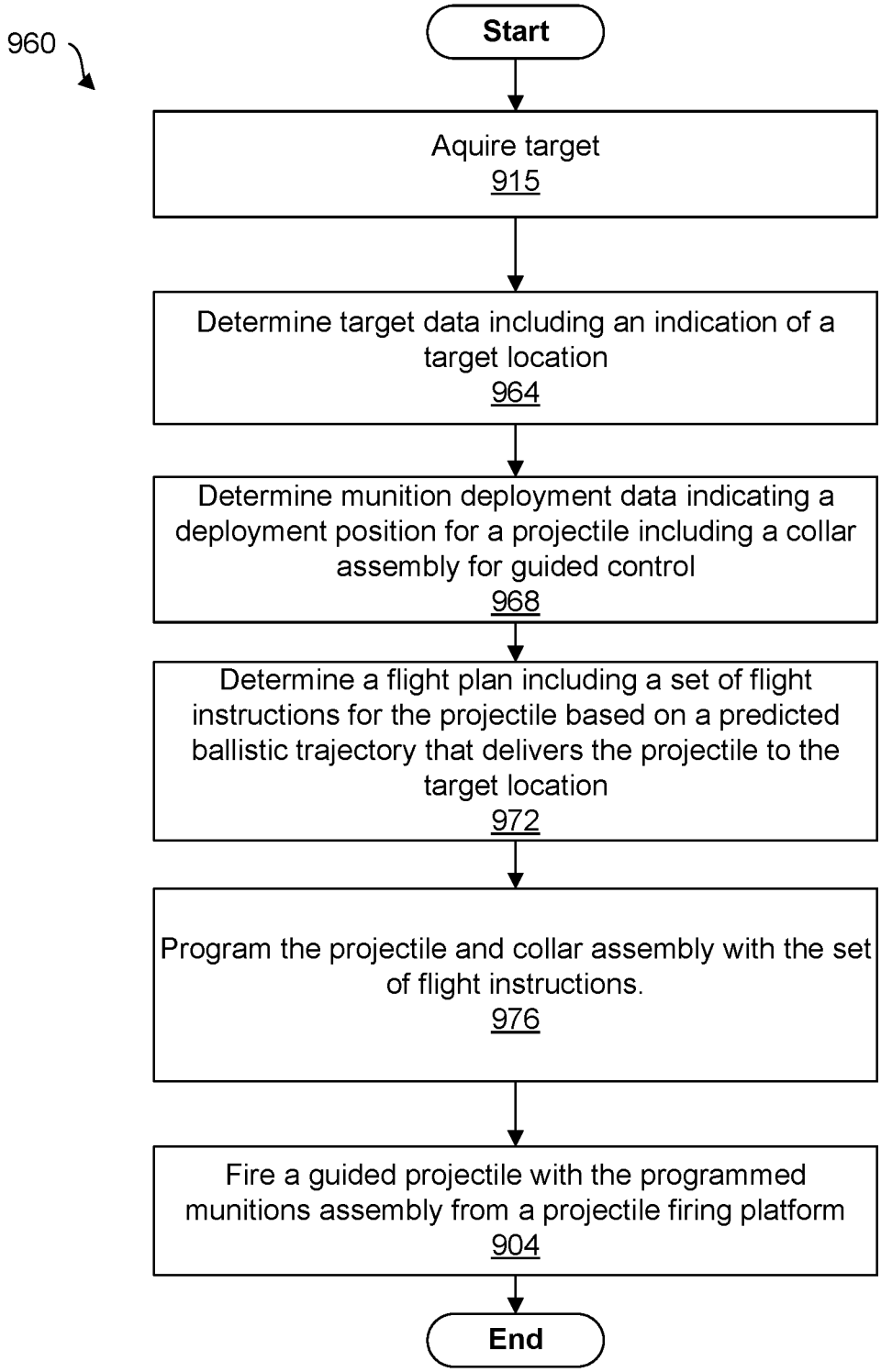
FIG. 14C depicts a method for configuring a guided projectile with a flight plan that delivers the projectile to a target location, according to one or more embodiments of the disclosure.

Referring to FIG. 14C, a method 960 is depicted for configuring a guided projectile prior to launch with a flight plan that delivers the projectile to a target location.

As such, in various embodiments, the method 960 includes, at operations 915 and 964, acquiring a target and determining target data including an indication of a target location. In various embodiments the target location could be acquired by a sensory array in projectile, a sensor array located on ground or in the air, or by other means, such as by receiving set of GPS coordinates that is manually or automatically generated and designate a target location for projectile impact.

In one or more embodiments, the method 960 includes, at operation 968, determining munition deployment data including a deployment position for an air-deployed munition including a collar assembly for guided control.

In various embodiments the method 930 includes, at operation 972, determining a flight plan for the munition, based on a predicted ballistic trajectory, that delivers a guided projectile to the target location. In various embodiments the flight plan includes a set of flight instructions for operation of the projectile while in flight. For instance, in certain embodiments the flight plan will include a set of instructions detailing one or more the wing sweep angle, roll angle, and other flight operations at various altitudes that the collar assembly should take over the course of its flight.

In various embodiments these instructions will correspond to a ballistic trajectory. For example, by executing a known set of flight instructions, a projectile will generally follow a predictable path from launch to eventual impact. As such, in various embodiments, operation 972 includes determining a flight plan based on a predicted ballistic trajectory that will deliver the projectile to the target.

Described further below, in various embodiments the predicted ballistic trajectory is an output result of a one or more projectile flight simulations. In certain embodiments each of the simulated flights produces a ballistic trajectory and a set of corresponding flight instructions that is associated with that ballistic trajectory. As such, in various embodiments, operation 972 can include determining a flight plan and a set of flight instructions for the collar assembly based on a predicted ballistic trajectory that, from flight simulations, is known to deliver the projectile to the target.

In one or more embodiments the method 960 includes, at operation 976 programming the projectile with the set of flight instructions corresponding to the determined flight plan. As described above, the set of flight instructions will configure the projectile and collar assembly with instructions for assuming various wing sweep angles, roll angles, and other flight operations. In various embodiment, the method 960 includes at operation 904, firing a projectile from a firing platform as described above.

One or more embodiments may be a computer program product. The computer program product may include a computer readable storage medium (or media) including computer readable program instructions for causing a processor control an in-flight spin rate of a spin-stabilized projectile, according to the various embodiments described herein. For example, as described above with reference to FIGS. 14A, 14B, and 14C in one or more embodiments the operations of these methods 900, 930, 960 are elements of a computer program product, included as program instructions that are embodied in a computer readable storage medium. As such, in various embodiments, these operations are program-instruction means for accomplishing various embodiments of the disclosure, such as described above with reference to the figures herein.

The computer readable storage medium is a tangible non-transitory device that can retain and store instructions for use by an instruction execution device. The computer readable storage medium may be, for example, an electronic storage device, a magnetic storage device, an optical storage device, or other suitable storage media.

A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Program instructions, as described herein, can be downloaded to respective computing/processing devices from a computer readable storage medium or to an external computer or external storage device via a network, for example, the Internet, a local area network, a wide area network and/or a wireless network. A network adapter card or network interface in each computing/processing device may receive computer readable program instructions from the network and forward the computer readable program instructions for storage in a computer readable storage medium within the respective computing/processing device.

Computer readable program instructions for carrying out one or more embodiments, as described herein, may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++ or the like, and conventional procedural programming languages, such as the "C" programming language or similar programming languages.

The computer readable program instructions may execute entirely on a single computer, or partly on the single computer and partly on a remote computer. In some embodiments, the computer readable program instructions may execute entirely on the remote computer. In the latter scenario, the remote computer may be connected to the single computer through any type of network, including a local area network (LAN) or a wide area network (WAN), or public network.

One or more embodiments are described herein with reference to a flowchart illustrations and/or block diagrams of methods, systems, and computer program products for operating a despun wing control system according to the embodiments described herein. It will be understood that each block of the flowchart illustrations and/or block diagrams, and combinations of blocks in the flowchart illustrations and/or block diagrams, may be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the functions/acts specified in the flowcharts and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some embodiments, the functions noted in the block may occur out of the order noted in the figures. For example, two blocks shown in succession may, in fact, be executed substantially concurrently, or the blocks may sometimes be executed in the reverse order, depending upon the functionality involved.

Figure 15:
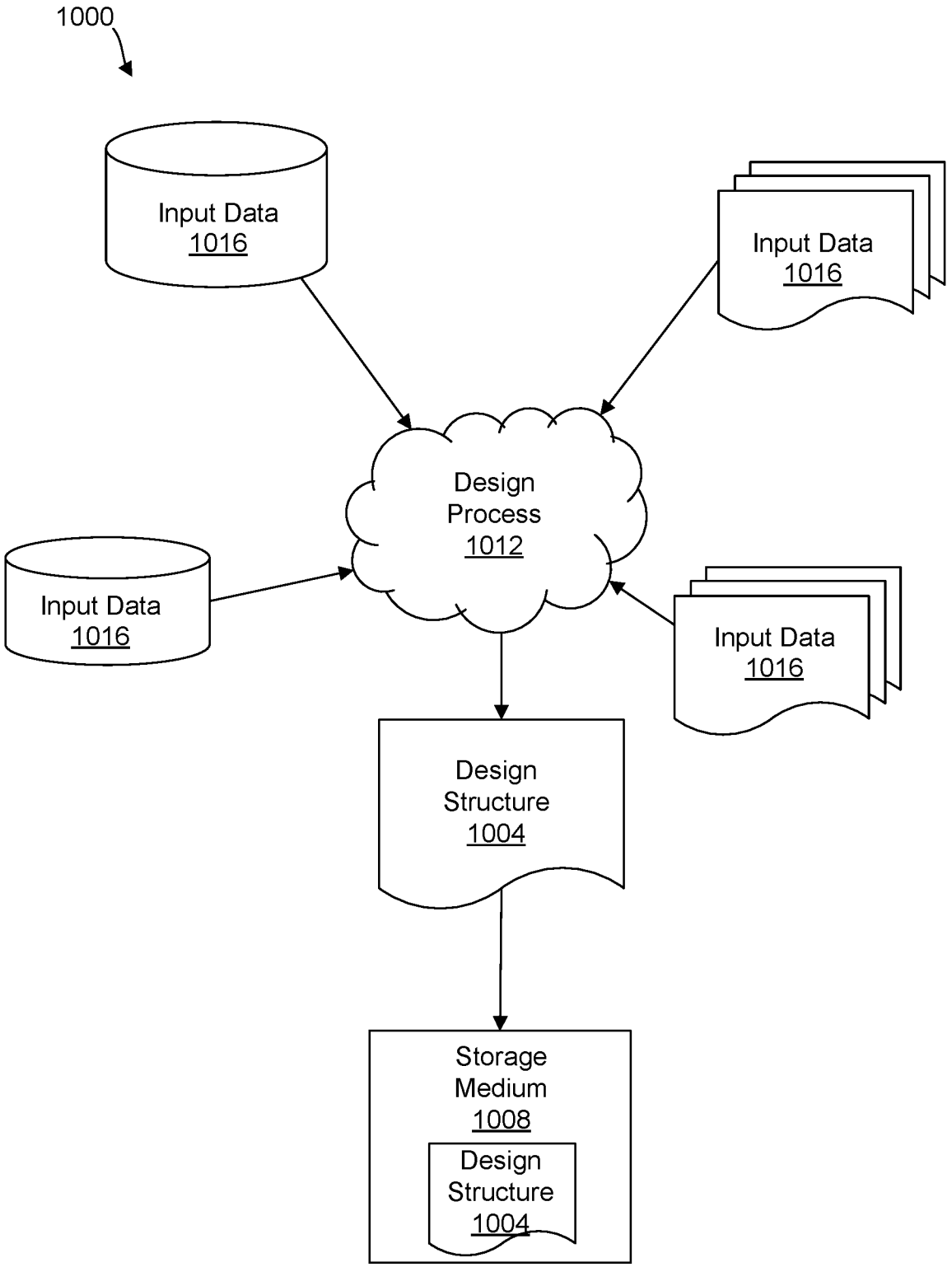
FIG. 15 depicts a flow diagram of a design process used in an operational simulation of a guided projectile flight, according to one or more embodiments of the disclosure.

FIG. 15 shows a block diagram of a design flow 1000 for generating a design structure 1004 encoded on a computer readable storage medium 1008 used for, in some embodiments, projectile and collar assembly flight simulation and testing. Design flow 1000 includes processes, machines and/or mechanisms for generating design structures comprising logically or otherwise functionally equivalent encoded representations of the systems and/or devices described herein. For example, design structures may include data and/or instructions that when executed or otherwise processed on a data processing system generate a structurally, mechanically, systematically, or otherwise equivalent representation of the plurality of munitions, the sensor devices, gateway devices, and command and control unit, as described herein with reference to the figures herein. The design structures processed and/or generated by design flow 1000 may be encoded or stored on any suitable computer readable storage media 1004.

Processes, machines and/or mechanisms for generating design structures may include, but are not limited to, any machine used in a projectile design process, such as designing, manufacturing, or simulating a projectile performance characteristics. For example, machines may include, computers or equipment used in projectile testing, or any machines for programming functionally equivalent representations of the design structures into any medium.

FIG. 15 illustrates a design structure 1004 that may be outputted by a design process 1012. Design structure 1004 may be a simulation to produce a functionally, structurally, systemic, and/or logically equivalent representation of an area denial system. In one or more embodiments, whether representing functional, structural, and/or system design features, design structure 1004 may be generated using electronic computer-aided design tools.

For example, in certain embodiments the design a structure is functionally/aerodynamically equivalent representation of a projectile including a despun or spun a collar assembly with a plurality of deployable wings with a variable wing sweep as described herein. In various embodiments, the design structure is encoded on a non-transitory machine-readable data storage medium. In various embodiments, the design structure includes elements that when processed in a computer-aided simulation, operates as a logically and functionally equivalent representation of an area denial system as described above with reference to the figured herein.

As such, design structure 1004 may comprise files or other data structures including human and/or machine-readable source code, compiled structures, and computer executable code structures that when processed by a design or simulation data processing system, functionally simulate or otherwise represent circuits or other levels of hardware logic design.

Design process 1012 may include processing a variety of input data 1016 for generating design structure 1004. Such data may include a set of commonly used components, and devices, including models, layouts, and performance characteristics. The input data may further include design specifications, design rules, and test data files which may include test results, and other testing information regarding components, devices, and circuits that are utilized in one or more of the embodiments of the disclosure. Once generated, design structure 1004 may be encoded on a computer readable storage medium or memory, as described herein.

Figure 16:
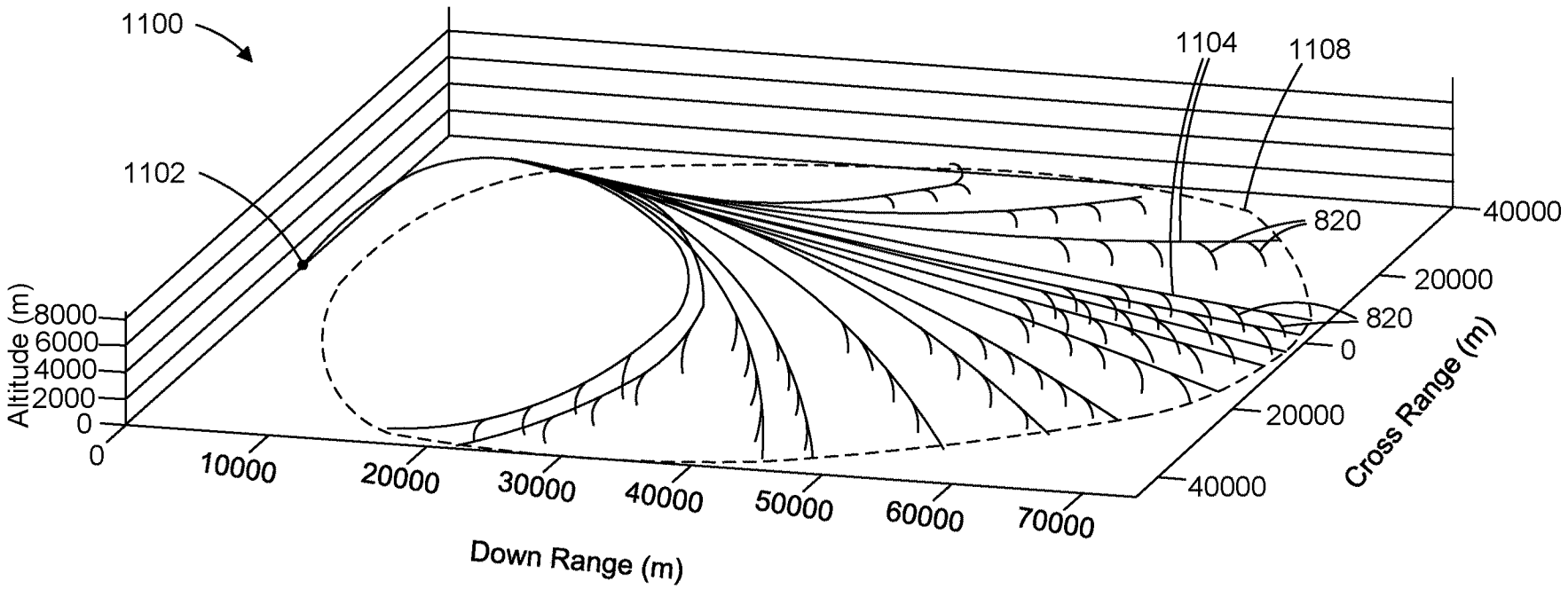
FIG. 16 depicts a design structure output of a simulation of a guided projectile according to one or more embodiments of the disclosure.

For example, referring to FIG. 16, a diagram 1100 is depicted showing the results of a design structure output of a simulation of guided projectile flight from a launch point 1102, such as design structure 504 as described above with reference to FIG. 15. Specifically, diagram 1100 is a computer program output of a MATLAB® simulation of guided projectile as described herein.

Depicted in FIG. 16 a plurality of ballistic trajectories 1104 are depicted. For simplicity, only a fraction of the total number of possible ballistic trajectories are depicted for the simulated projectile. Instead, the range total range of possible ballistic trajectories 1104 is represented as an impact area 1108 shown using a dashed line that represents the potential target engagement maneuver footprint down-range and cross-range which the projectile is capable of targeting using guided control via the collar assembly, as described above.

As described herein, the ballistic trajectories 1104 are output results of a one or more projectile flight simulations. In certain embodiments each of the simulated flights produces a set of corresponding flight instructions that is associated with that ballistic trajectory. As such, in various embodiments, each ballistic trajectory 1104 corresponds with a set of flight instructions for the collar assembly based from flight simulations that is known to deliver the projectile to a specific impact location within the impact area 1108.

As described above with reference to FIG. 13, in various embodiment the ballistic trajectories 1104 each include a terminal guidance phase 820. In various embodiments, and as described above, the additional maneuverability provided by the collar assembly may be used to shape the trajectory of the ballistic trajectory to provide the optimal angle of fall for lethality. In certain embodiments, more control over the shape of the terminal guidance phase 200 occurs further in from the perimeter of the impact area 1108.

Figure 17:
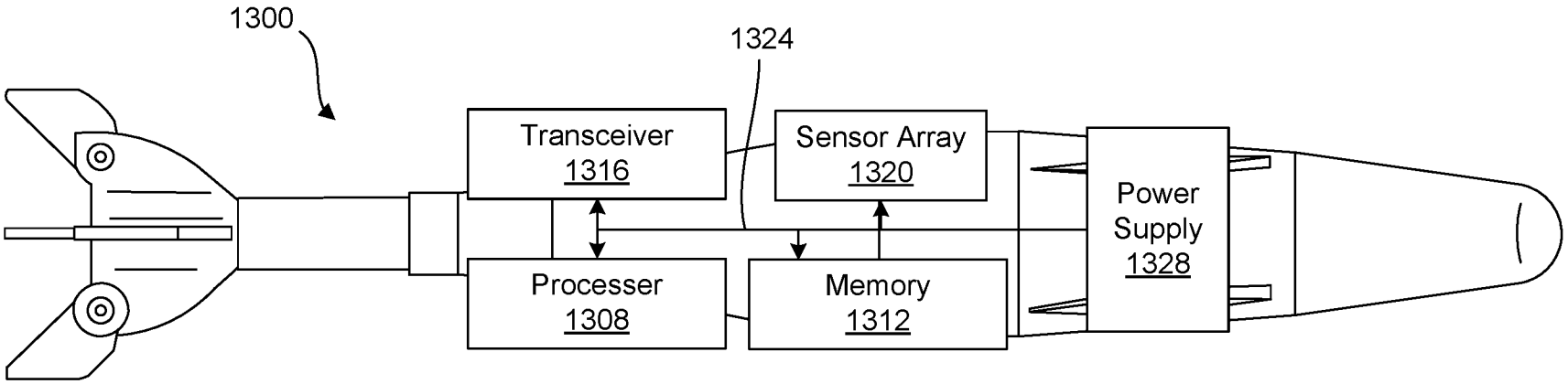
FIG. 17 depicts a system architecture for a guided projectile, according to one or more embodiments of the disclosure.

Referring to FIG. 17, a system architecture for a guided projectile 1300 is depicted, according to one or more embodiments. In various embodiments, guided projectile 1300 is the same or substantially similar to guided projectile 100 described above and depicted with reference to at least FIGS. 1-7 and guided projectile 200 described above and depicted with reference to at least FIGS. 8-11. The guided projectile 1300 may include a processor 1308, memory 1312, a transceiver 1316, a sensor array 1320, and a bus 1324 that couple the various system components. In one or more embodiments, the various components in the guided projectile 1300 represent a special purpose computing system for projectile flight control, sensor based target measurements, in-flight spin rate control, and for other functions, according to embodiments disclosed herein.

In one or more embodiments, the guided projectile 1300 may include executable instructions, such as program modules, stored in memory 1312 (e.g. computer readable storage medium) for execution by the processor 1308. Program modules may include routines, programs, objects, instructions, logic, data structures, and so on, that perform particular tasks according to one or more of the embodiments described herein.

In one or more embodiments, the guided projectile 1300 includes the sensor array 1320 for determining projectile velocity, projectile spin rate, and other data for determining an SG for the projectile 1300.

In various embodiments, guided projectile 1300 includes a power source 1328 in the form of an alternator that is configured to generate power for the projectile 1300. For example, in one or more embodiments, when fired, a flight control portion in the form of a collar is aerodynamically despun relative to the remainder of the projectile 1300 causing relative rotation between elements of the alternator and thereby generating sufficient power for operation of the processor 1308, memory 1312, transceiver 1316, and sensor array 1320. In certain embodiments, power source 1328 may additionally include a battery.

In addition to the above, U.S. Pat. Nos. 4,373,688; 4,438,893; 4,512,537; 4,568,039; 5,425,514; 5,780,766; 6,314,886; 6,502,786; 7,354,017; 7,849,800; 8,319,164; and 9,086,258 are incorporated herein by reference in their entirety for all purposes.

The descriptions of the various embodiments of the present disclosure have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to explain the principles of the embodiments, the practical application or technical improvement over technologies found in the marketplace, or to enable others of ordinary skill in the art to understand the embodiments disclosed herein.

What is claimed is:

1. A projectile having a nose portion with a forward tip, a body portion including a chassis defining a sidewall, a tail portion, and a central axis, the projectile comprising:

a control support portion extending axially from the nose portion to the body portion; and a collar assembly comprising:

a collar pivotally mounted to the control support portion, the collar having a circumferentially and axially extending exterior sidewall; and a plurality of variable sweep wings for directional control of the projectile, the plurality of variable sweep wings each have a first end portion pivotally mounted to an interior of the collar and coupled to a wing actuator configured to pivot a second end portion of each of the plurality of variable sweep wings between and including a first position, where the plurality of variable sweep wings are oriented having a lengthwise wing axis generally parallel to the central axis of the projectile, a second position, where the second end portion of the plurality of variable sweep wings are rotated outwardly from the sidewall of the collar and where the lengthwise wing axis of the plurality of variable sweep wings are oriented generally perpendicular to the central axis of the projectile, and a third position, where the lengthwise wing axis of the plurality of variable sweep wings has a wing sweep angle with respect to the central axis of the projectile.

2. The projectile of claim 1, wherein the exterior sidewall of the collar comprises a plurality of fixed aerodynamic surfaces thereon for spinning the collar, and wherein the collar assembly includes one or more power generation components secured to one or more of the collar and the control support portion for providing power generation in response to the spinning of the collar and for braking the spinning of the collar.

3. The projectile of claim 1, wherein the collar assembly is positioned forward of 50% of a total length of the projectile or forward of 60% of a total length of the projectile.

4. The projectile of claim 1, wherein the collar assembly and the control support portion are configured as a portion of a fuse assembly that is removably attached to the projectile.

5. The projectile of claim 1, wherein each of the plurality of variable sweep wings are canted, at a fixed angle with respect to the central axis of the projectile, for generating a maneuvering torque on the projectile.

6. The projectile of claim 1, wherein the wing sweep angle is an acute angle.

7. The projectile of claim 6, wherein the wing actuator is further configured to rotate the second end portion forwardly and rearwardly between and including the first position, second position, and third position.

8. The guided projectile of claim 1, wherein the wing actuator is further configured to rotate the second end portion to one or more of the first position and the second position based on the altitude of the projectile.

9. The guided projectile of claim 1, wherein, when in the first position, no portion of the plurality of variable sweep wings extends outwardly beyond an outer envelope of the collar.

10. The guided projectile of claim 1, wherein the plurality of variable sweep wings include two wings arranged on opposing portions of the collar assembly, the two wings configured each configured to rotate from the first position towards the second position in one of a forward direction and a rearward direction and additionally configured to rotate from the second position towards the first position in the other of the forward direction and the rearward direction.

11. A method of guiding to a target a projectile including a chassis extending from a tail portion to a body portion, the chassis defining a sidewall of the body portion, the projectile further including a control support portion extending axially from a nose portion and connecting to the body portion and a collar assembly having a collar pivotally mounted to the control support portion, the collar having a circumferentially and axially extending exterior sidewall with a plurality of fixed aerodynamic surfaces thereon for spinning the collar and the collar having a plurality of variable sweep wings canted at a fixed angle with respect to the central axis of the projectile for directional control of the projectile, the plurality of variable sweep wings each having a first end portion pivotally mounted to an interior of the collar and coupled to a wing actuator configured to rotate a second end portion between and including a first position, where the wings are oriented having a lengthwise wing axis generally parallel to the central axis of the projectile to a second position, where the second end portion of the wings are rotated outwardly from the sidewall of the collar and where the lengthwise wing axis of the plurality of wings are oriented generally perpendicular to the central axis of the projectile, the method comprising:

firing the projectile from a projectile firing platform, the projectile having the plurality of variable sweep wings configured in the first position;

determining the projectile has reached a first altitude threshold; and deploying, in response to determining the projectile has reached the first altitude, the plurality of variable sweep wings from the first position to the second position for gliding and maneuvering.

12. The method of claim 11, wherein the method further comprises:

determining that the projectile has reached a second altitude threshold; and configuring, in response to determining the projectile reached the second altitude, the plurality of variable sweep wings from the second position to a third position, between the first and second position, where the longitudinal wing axis has a wing sweep angle with the central axis that is an acute angle.

13. The method of claim 12, wherein the second altitude threshold is less than the first altitude threshold.

14. The method of claim 11, wherein the method further comprises acquiring the target, and wherein configuring the plurality of variable sweep wings from the second position to the third position is further in response to acquiring the target.

15. The method of claim 11, wherein the collar assembly, the nose portion, and the control support portion are configured as a fuse assembly removably attached to the body portion.

16. The method of claim 11, wherein the collar assembly is positioned forward of 60% of a total length of the projectile.

17. A system for guiding a projectile, the system removably attachable to a chassis of a projectile to configure the projectile for guided flight, the system comprising:

a projectile nose portion and a control support portion extending axially from the nose portion;

a collar assembly having a collar pivotally mounted to the control support portion, the collar having a circumferentially and axially extending exterior sidewall and the collar having a plurality of variable sweep wings for directional control of the projectile, the plurality of variable sweep wings each having a first end portion pivotally mounted to an interior of the collar and coupled to a wing actuator configured to rotate a second end portion between and including a first position, where the wings are oriented having a lengthwise wing axis generally parallel to the central axis of the projectile to a second position, where the second end portion of the wings are rotated outwardly from the sidewall of the collar and where the lengthwise wing axis of the plurality of wings are oriented generally perpendicular to the central axis of the projectile; and a processor and a non-transitory computer readable storage medium, wherein the computer readable storage medium includes a set of instructions executable by the processor to cause the processor to:

determine that the projectile has reached a first altitude threshold, and in response, deploying the plurality of variable sweep wings from the first position to the second position for gliding and maneuvering;

determine that the projectile has reached a second altitude threshold, and in response configuring the plurality of variable sweep wings from the second position to a third position, between the first and second position, where the longitudinal wing axis has a wing sweep angle with the central axis that is an acute angle.

18. The system of claim 17, wherein the collar assembly includes a plurality of fixed aerodynamic surfaces for spinning the collar and one or more power generation components secured to one or more of the collar and the control support portion for providing power generation in response to the spinning and for braking of the spinning.

19. The system of claim 17, wherein the instructions are executable by the processor to further cause the processor to acquire the target, and wherein configuring the plurality of variable sweep wings from the second position to the third position is further in response to acquiring the target.

20. The system of claim 17, wherein the plurality of variable swept wings include only two wings arranged on opposing portions of the collar assembly, the two wings configured each configured to rotate from the first position towards the second position in one of a forward direction and a rearward direction and additionally configured to rotate from the second position towards the first position in the other of the forward direction and the rearward direction.

* * * * *